US005409085A

United States Patent [19]

Fujino et al.

[11] Patent Number: 5,409,085

[45] Date of Patent: Apr. 25, 1995

[54] GROUP CONTROL ELEVATOR SYSTEM FOR AUTOMATICALLY ADJUSTING ELEVATOR OPERATION BASED ON A EVALUATION FUNCTION

[75] Inventors: Atsuya Fujino; Toshimitsu Tobita, both of Hitachi; Hiromi Inaba, Katsuta; Kiyoshi Nakamura, Katsuta; Yoshio Sakai, Ibaraki; Kenji Yoneda; Hiroaki Yamani, both of Katsuta, all of Japan

[73] Assignee: Hitachi, Ltd., Tokyo, Japan

[21] Appl. No.: 156,980

[22] Filed: Nov. 24, 1993

Related U.S. Application Data

[63] Continuation of Ser. No. 686,366, Apr. 17, 1991, abandoned.

[30] Foreign Application Priority Data

Apr. 18, 1990 [JP] Japan ..... 2-100333

[51] Int. Cl.[6] ..... B66B 1/18

[52] U.S. Cl. ..... 187/380; 187/247

[58] Field of Search ..... 187/124, 127, 121, 101, 187/125, 128

[56] References Cited

U.S. PATENT DOCUMENTS

| | | | |
|---|---|---|---|
| 4,760,896 | 8/1988 | Yamaguchi | 187/124 |
| 4,930,604 | 6/1990 | Schienoa et al. | 187/133 |
| 4,947,965 | 8/1990 | Kuzunuki et al. | 187/127 |
| 4,984,174 | 1/1991 | Yasunobu et al. | 364/513 |
| 4,989,695 | 2/1991 | Kubo | 187/101 |
| 5,010,472 | 4/1991 | Yoneda et al. | 364/148 |
| 5,022,498 | 6/1991 | Sasaki et al. | 187/127 |
| 5,024,295 | 6/1991 | Thangavelu | 187/127 |
| 5,054,585 | 10/1991 | Amano | 187/124 |
| 5,168,133 | 12/1992 | Bahjat et al. | 187/125 |
| 5,229,559 | 6/1993 | Siikonen et al. | 187/124 |
| 5,239,141 | 8/1993 | Tobita et al. | 187/127 |

FOREIGN PATENT DOCUMENTS

| | | | |
|---|---|---|---|
| 01-192682 | 8/1989 | Japan . | |
| 01-226677 | 9/1989 | Japan . | |
| 01-226679 | 9/1989 | Japan . | |
| 01-231778 | 9/1989 | Japan . | |
| 2240196 | 7/1991 | United Kingdom | 187/124 |

*Primary Examiner*—Steven L. Stephan
*Assistant Examiner*—Robert Nappi
*Attorney, Agent, or Firm*—Antonelli, Terry, Stout & Kraus

[57] ABSTRACT

The present invention relates to a group control elevator system which has been adjusted to operate in response to a state of utilizing elevator cars. In a group control elevator system which carries out a control of allocating elevator cars to elevator car calls for serving many floors by using an evaluation function having a plurality of variable parameters, targets for elevator control performance are inputted, a traffic flow to which elevator car demand belongs is judged, variable parameters to be adjusted which have been set in advance for each combination of said targets and traffic flows are stored, stored variable parameters are adjusted, adjustment sequence of variable parameters to be adjusted is stored, and a plurality of variable parameters are sequentially adjusted according to the stored sequence. By the above arrangement, only desired parameters to be adjusted are selected and adjusted out of a plurality of variable parameters for desired targets and traffic flows. Accordingly, an increase in time required for adjustment can be restricted even if there has been an increase in the number of variable parameters to be adjusted.

8 Claims, 21 Drawing Sheets

FIG. 13A

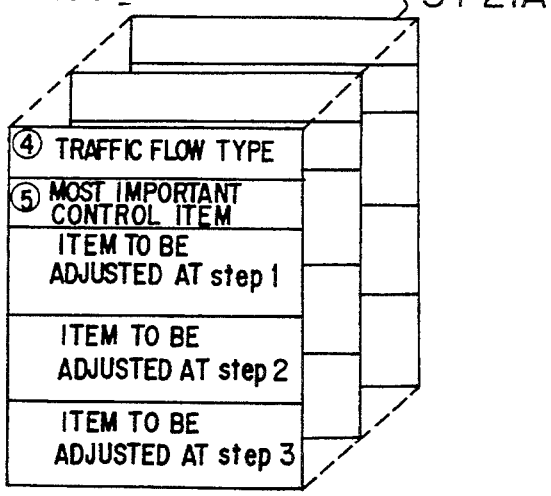

FIG. 13B

| | NORMAL TIME | EARLIER HALF OF LUNCH TIME |
|---|---|---|
| EQUAL FOR THREE ITEMS | THRESHOLD VALUE → AREA VALUE → BOARDING COEFFICIENT | THRESHOLD VALUE → AREA VALUE → BOARDING COEFFICIENT |
| PRIORITY FOR WAITING TIME | AREA VALUE → THRESHOULD VALUE | AREA VALUE → THRESHOLD VALUE → BOARDING COEFFICIENT |
| PRIORITY FOR BOARDING TIME | THRESHOLD VALUE → BOARDING COEFFICIENT → AREA VALUE | BOARDING COEFFICIENT → THRESHOLD VALUE |
| PRIORITY FOR CROWDEDNESS | THRESHOLD VALUE → AREA VALUE → BOARDING COEFFICIENT | THRESHOLD VALUE → BOARDING COEFFICIENT → AREA VALUE |

FIG. 13C

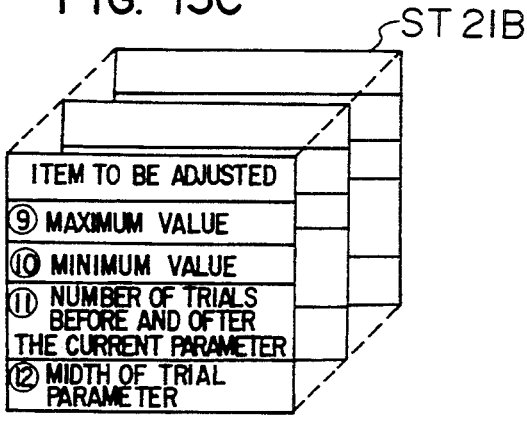

FIG. 23

TUNING RECORDING TABLE TNRC

TRAFFIC FLOW MODE :

TRAFFIC FLOW MODE :

TRAFFIC FLOW MODE: NORMAL TIME AM TIME: 9:30~11:45 PREFERENCE: BOARDING TIME WITH PRIORITY

| DATA OF ADJUSTMENT | ESTIMATED BOARDING TIME MULTIPLICATION FACTOR | BOARDING RATE SET VALUE | AREA VALUE | ESTIMATED VALUES | | | ACTUAL MEASURED VALUES | | |
|---|---|---|---|---|---|---|---|---|---|
| | | | | WAITING TIME | BOARDING TIME | CROWDEDNESS | WAITING TIME | BOARDING TIME | CROWDEDNESS |
| 90. 1/20 | 0.0 | 80 | 0 | 19.5 | 36.0 | 6.3 | 17.9 | 36.4 | 0.7 |
| 90. 1/27 | 0.0 | 50 | 0 | 19.9 | 35.2 | 4.0 | 17.6 | 35.3 | 0.0 |
| 90. 2/3 | 0.6 | 50 | 0 | 18.6 | 34.5 | 2.0 | 19.2 | 33.8 | 0.8 |
| 90. 2/10 | 0.6 | 50 | 0 | 18.6 | 34.5 | 2.0 | 19.2 | 33.8 | 0.8 |
| 90. 2/17 | 0.6 | 30 | 0 | 20.6 | 34.0 | 1.1 | 19.0 | 32.8 | 0.9 |
| 90. 2/24 | 1.0 | 30 | 0 | 20.6 | 32.7 | 2.0 | | | |
| ⋮ | ⋮ | ⋮ | ⋮ | ⋮ | ⋮ | ⋮ | ⋮ | ⋮ | ⋮ |

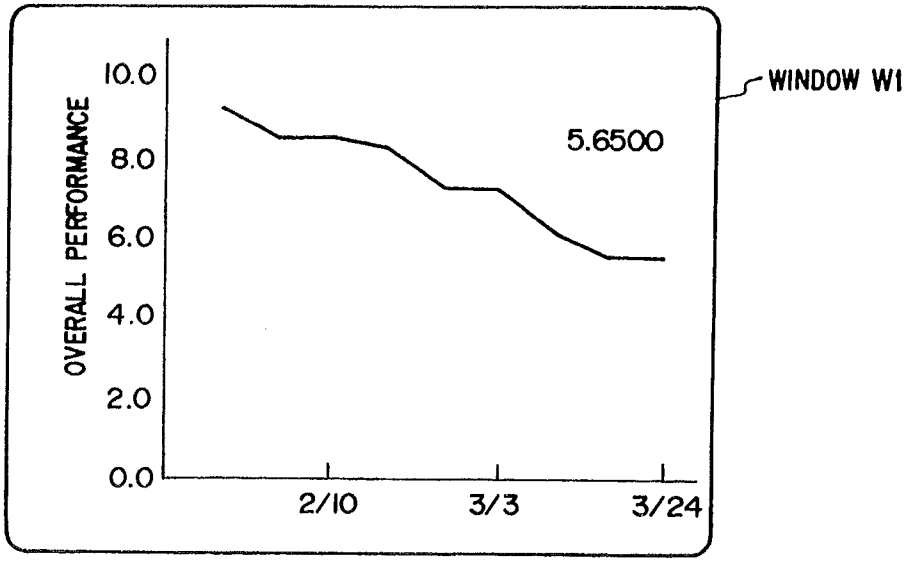
FIG. 24A
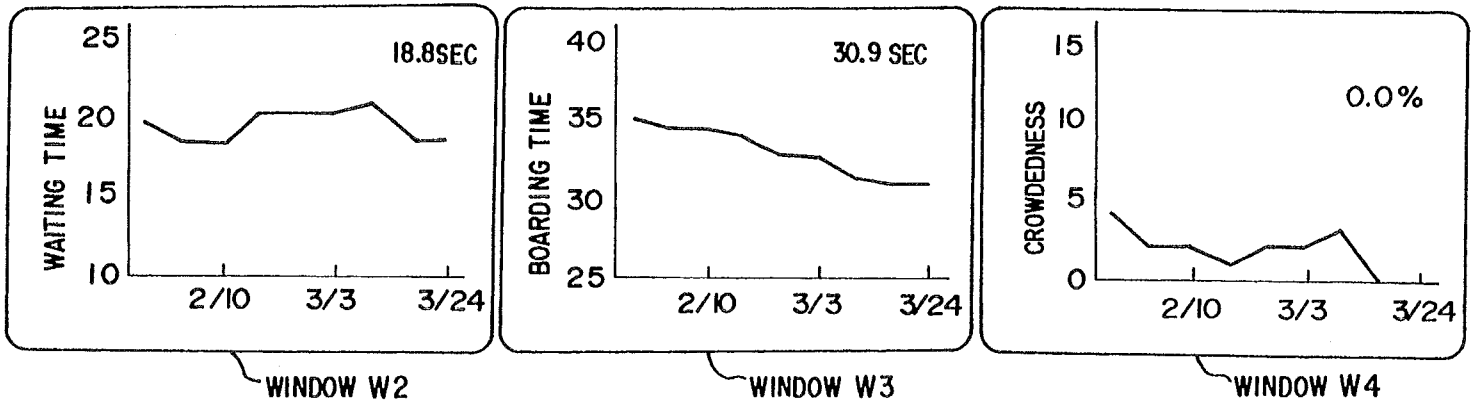
FIG. 24B
FIG. 24C
FIG. 24D

FIG. 24E

TABLE T1

TRAFFIC FLOW: NORMAL TIME AM PREFERENCE: BOARDING TIME IS MOST IMPORTANT

| DATA OF ADJUSTMENT | BOARDING TIME MULTIPLICATION FACTOR | SET BOARDING RATE | AREA VALUE |
|---|---|---|---|
| INITIAL VALUE | 0.0 | 80 | 0 |
| 90. 1/27 | 0.0 | 50 | 0 |
| 90. 2/3 | 0.6 | 50 | 0 |
| 90. 2/10 | 0.6 | 50 | 0 |
| 90. 2/17 | 0.6 | 30 | 0 |
| 90. 2/24 | 1.0 | 30 | 0 |
| 90. 3/3 | 1.0 | 30 | 0 |
| 90. 3/10 | 1.0 | 20 | 0 |
| 90. 3/17 | 0.8 | 20 | 0 |
| 90. 3/24 | 0.8 | 20 | 0 |
| | (TIMES) | (%) | (TIMES) |

GROUP CONTROL ELEVATOR SYSTEM FOR AUTOMATICALLY ADJUSTING ELEVATOR OPERATION BASED ON A EVALUATION FUNCTION

This application is a continuation of application Ser. No. 07/686,366, filed on Apr. 17, 1991, now abandoned.

BACKGROUND OF THE INVENTION

The present invention relates to a group control elevator system, and in particular to a group control elevator system having an improved adjustment function for adapting operation of elevators to individual utilization states of the elevators for each building.

Conventional technology of group control elevator systems are known as described in the Japanese Patent Unexamined Publication No. JP-A-58-52162 and JP-A-5863668, for example.

In the systems techniques described in the above publications, variable parameters are used to structure an "allocation evaluation function" for evaluating the allocation of an elevator cage which provides service to a call for an elevator car at a boarding floor, and control of the elevator operation is carried out by allocating the call for an elevator cage to the cage which optimizes this evaluation function. In the meantime, the group control elevator system learns a state of move of elevator utilizers which shows a unique and individual pattern depending on the building in which the elevator system is accommodated, by classifying the move state by individual characteristics as a "traffic flow". Then, based on a simulation which is carried out by utilizing the traffic flow that has been learned, a control method (the variable parameter) is automatically adjusted. An optimum group control of the elevator system is realized for each traffic flow of each building having the elevator system, based on the combination of the group control function, the traffic flow learning function and the automatic adjusting function.

As another conventional technology of a group elevator control system, control of an elevator system by considering many target items such as reduction in an elevator car boarding time and reduction in crowdedness of a cage as well as the conventional reduction in an elevator car waiting time is disclosed in the HITACHI HYORON, Vol. 71, No. 5 of 1989-5, pp. 115–122. This control system makes it possible to set many targets such as reduction in waiting time, reduction in boarding time and reduction in crowdedness of an elevator cage, and realizes a group control elevator system to meet the requirement of the utilizers.

In the above-described group control elevator system for controlling the operation of the elevator system based on an overall evaluation of many purposes, how to take balance among the targets causes a concern and, therefore, there is a problem that the group control elevator system is more seriously affected by a traffic flow which is possessed by individual buildings than other conventional systems. Accordingly, in order to expect an elevator control system which meets the actual situation, a self-adaptive technology is required as disclosed in the above JP-A-58-52162.

However, if a system for automatically adjusting a variable parameter by simulation, like the above-described conventional technique, is used directly for multi-purpose control, the number of kinds of parameters to be adjusted increases. The number of simulations required to obtain an optimum value for all the parameters in this case increases by the power of a combination of the variable parameters, so that a very large number of simulations is required. Accordingly, there is a problem that a very long time is required before an optimum elevator control operation is effected to meet the change in the elevator car utilization state if the control is to be based on the variable parameters obtained by a large number of simulations.

SUMMARY OF THE INVENTION

It is a main object of the present invention to provide a group control elevator system which solves the above-described problems of the conventional technique and which can restrict an increase in the time required for adjusting variable parameters even if the number of parameters has increased.

It is another object of the present invention to provide a group control elevator system which can restrict a substantial increase in the time of adjusting a plurality of variable parameters when the variable parameters to be adjusted are sequentially adjusted.

In order to achieve the above objects, in one aspect of the present invention, a group control elevator system for controlling an allocation of a plurality of elevator cars to car calls at a plurality of floors by using an evaluation function having a plurality of variable parameters comprises a unit for inputting targets for an elevator control performance, a unit for deciding a traffic flow to which a demand for elevator cars belongs, a unit for storing variable parameters which have been preset for each combination of the targets and the traffic flow and a unit for adjusting the stored variable parameters.

In another aspect of the present invention, the group control elevator system includes a unit for storing adjusting sequence for adjusting the sequence among the variable parameters and a unit for sequentially adjusting the plurality of variable parameters in accordance with this stored sequence.

Accordingly, in the present invention, only the parameters to be adjusted are selected from the plurality of variable parameters and the variable parameters are adjusted to meet the required targets and the traffic flow.

Further, there is no substantial increase in the time required to adjust a plurality of variable parameters when they are sequentially adjusted.

BRIEF DESCRIPTION OF THE DRAWINGS

Preferred embodiments of the present invention will now be described in conjunction with the accompanying drawings, in which;

FIGS. 13A to 13C show variable parameters and automatic adjustment proceeding data tables as an adjustment sequence storage unit for the variable parameters;

FIG. 23 is an adjustment record table used in steps in FIG. 22; and

FIGS. 24A to 24E show examples of a display of adjustment result in an automatic adjustment result display unit according to the present invention.

DESCRIPTION OF THE PREFERRED EMBODIMENTS

An embodiment of the group control elevator system according to the present invention will be explained below with reference to FIGS. 1 to 21. In the following explanation, description will be made of an example of the case where three targets of (1) reduction of waiting time, (2) reduction of boarding time and (3) reduction of crowdedness in the cage are taken as variable parameters which are target items for the group control. However, it is needless to mention that it is also possible to apply the present invention to other cases where various control targets have been set, without limitation of the number of control targets and control target items to the above.

Figure 1:
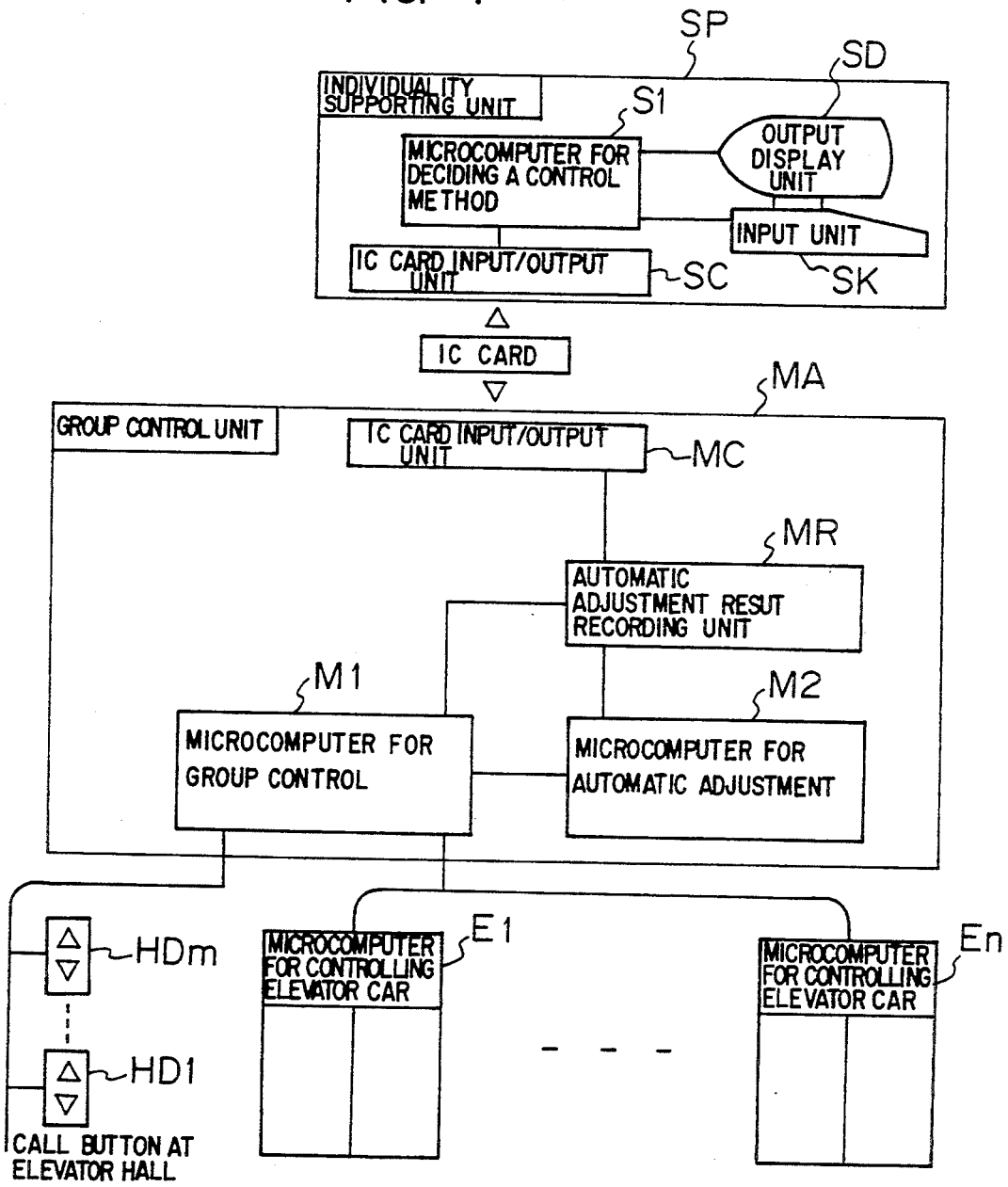
FIG. 1 is an overall configuration block diagram showing one embodiment of the group control elevator system according to the present invention.

FIG. 1 is an overall configuration block diagram of the group control elevator system in one embodiment of the present invention.

The group control elevator system comprises a group control unit MA as a center, elevator cars controlling microcomputers $E_1$, - - - , and $E_n$, and elevator car call buttons at elevator halls $HD_1$, - - - , and $HD_m$. Further, an individuality supporting unit SP to be off-line connected when necessary is provided in the group control unit MA.

In the following embodiment, number of elevator cars is expressed as n cars and number of service floors is expressed as m floors.

The individuality supporting unit SP which has a role of accepting users' requirements and deciding a control method (parameter) to achieve the requirements, comprises a microcomputer S1 for deciding a control method, an input unit SK for inputting a target, an output (display) unit SD and an IC card input and output unit SC.

The group control unit MA comprises a microcomputer M1 for executing the group control, a microcomputer M2 for automatic adjustment, an automatic adjustment result recording unit MR and an IC card input and output unit MC.

The automatic adjustment microcomputer M2 comprises:

(1) a unit for adjusting a stored variable parameter;

(2) a unit for sequentially adjusting a plurality of variable parameters in accordance with stored sequence;

(3) a unit for sequentially adjusting variable parameters; and (4) a unit for automatically adjusting variable parameters.

The processing of the group control microcomputer M1 and the automatic adjustment microcomputer M2 will be explained first.

Based on a control method instructed from the automatic adjustment microcomputer M2, the group control microcomputer M1 selects a service elevator car to meet a requirement from a call signal at an elevator hall sent by a pressing of a call button HD at the hall, and sends an allocation signal to a microcomputer $E_n$ (n=1, 2, - - -) for controlling the service elevator car that has been selected. This processing corresponds to the group control unit. At the same time as the execution of the allocation processing (group control), the group control microcomputer M1 measures a result of control of (1) an average waiting time, (2) an average boarding time and (3) an average degree of crowdedness of cages, based on data of continuous time of waiting by pressing call buttons at elevator halls, continuous time of waiting by pressing wait buttons in elevator cages and changes in cage weights, and learns a traffic flow which is a state of utilizing the elevator system. This processing corresponds to the control result measuring unit.

The automatic adjustment microcomputer M2 receives an initial control method (parameter) from the individuality supporting unit SP and executes automatic adjustment of the control method based on the result of learning of the traffic flow which is unique to each building. The result of this automatic adjustment is recorded by the automatic adjustment result recording unit MR and can be displayed in the output (display) unit SD.

The output (display) unit SD comprises: (1) a unit for inputting a target for elevator control performance; (2) a unit for displaying a result of adjustment in time series; and (3) a unit for displaying a result of adjustment as a numerical change of a target item.

Next, an outline of "a sequential adjusting system" for sequentially adjusting a plurality of parameters, which is one of the key subjects of the present will be explained with reference to FIGS. 2A and 2B.

It is clear that it is impossible to realize a control which makes it possible to harmonize many targets to meet requirements of elevator car users by using a fixed control method. When a group control system is used which employs an allocation evaluation function using variable parameters, it is necessary to use a parameter which is a main element for improving each control target item and a parameter for adjusting control targets, so that number of parameters will increase unavoidably.

In order to find an optimum parameter from a combination of all the parameters, it is necessary to carry out simulation by using all the potential combination of parameter value and then compare the result of all the simulation. For example, when three sets of variable parameters awe used based on three control target items and if five different parameter values are assumed for each of the three targets, then it is necessary to carry out 125 simulations as illustrated by round circles in FIG. 2A $$5\times5\times5=125 \quad (1)$$

Figure 2A:
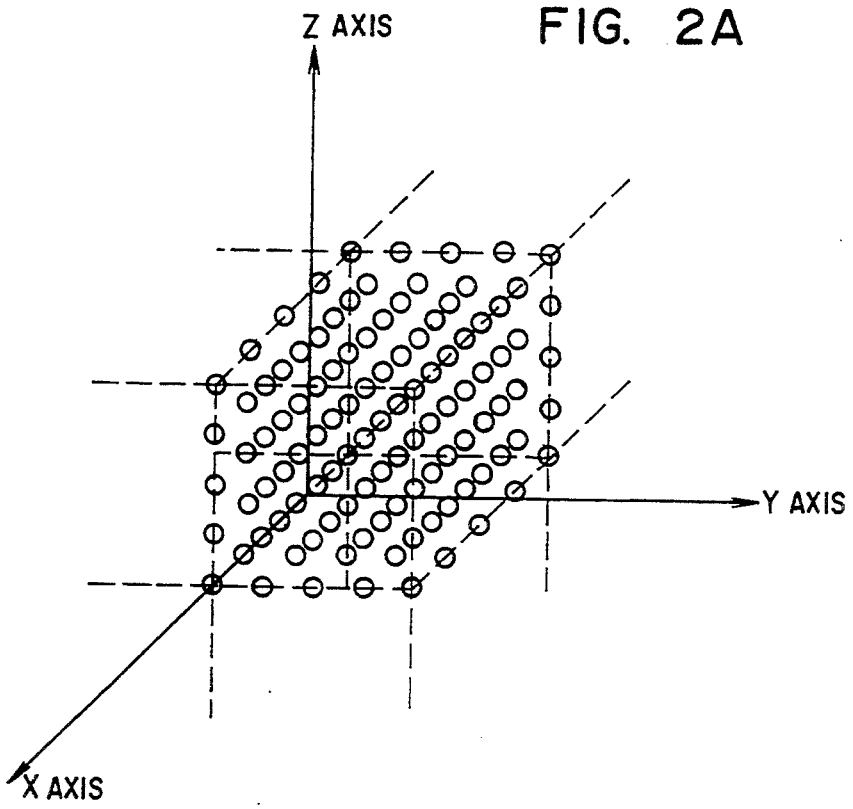
FIGS. 2A and 2B are explanatory diagrams for explaining a sequential adjusting system used in the present invention.
Figure 2B:
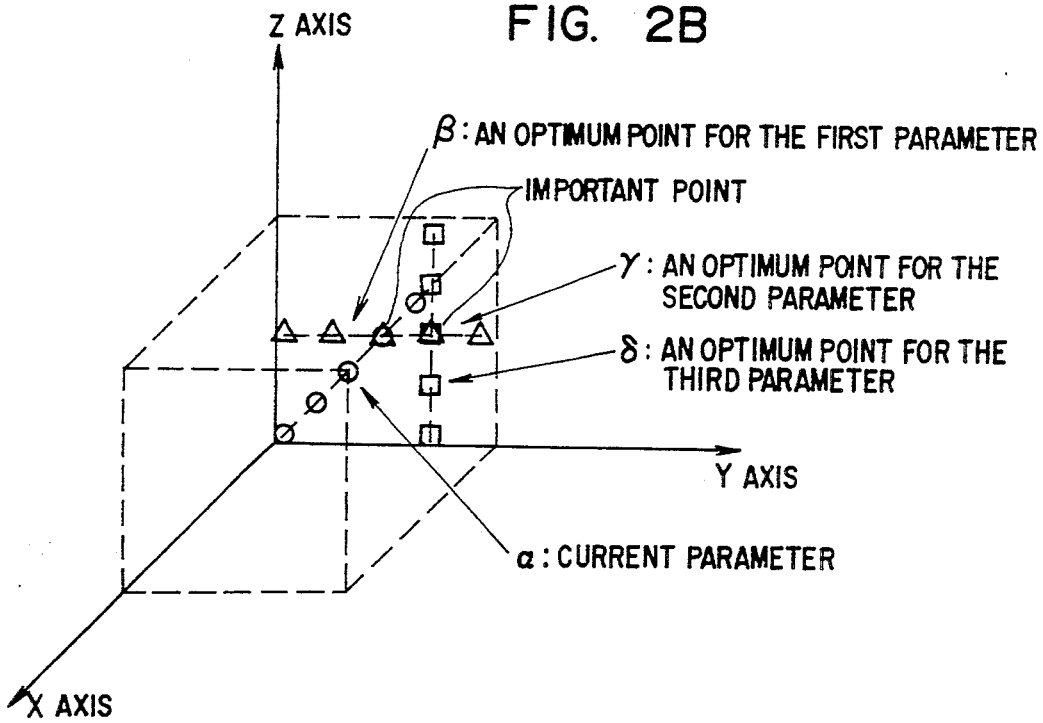

FIG. 2A shows three variable parameters in the direction of the X axis, Y axis and Z axis respectively.

It is desirable that the above simulation is carried out by the automatic adjustment microcomputer M2 which is separate from the group control microcomputer M1 in the group control unit. However, there is a limit to the processing speed of the automatic adjustment microcomputer M2, or this microcomputer M2 cannot be operated much faster than the group control microcomputer M1, because the automatic adjustment microcomputer M2 often has other function in addition to its main function, that is, the automatic adjustment microcomputer M2 also has a function of backing up the group control microcomputer M1 when it is in fault and because the automatic adjustment microcomputer M2 often shares a memory in the group control unit. In other words, it is difficult to reduce time required for the simulation. Therefore, about 10 minutes are required to carry out a simulation of a 30-minute actual operation, for example.

As a result, when seven typical types of traffic flow mode including an office starting time zone, an office leaving time zone, a normal office hour time zone, a former half of lunch time zone, a latter half of lunch time zone, a crowded time zone and a slack time zone, are to the adjusted based on the simulation of all the potential cases, about six days are required to carry out all the simulation.

$$125\times10\times7=8750 \text{ minutes} \quad (2)$$

Further, when the number of variable parameters increases n times, time required for automatic adjustment increases in the order of the power of n. Therefore, it is not practical to carry out adjustment of parameters of multiple target control based on all possible combinations.

In contrast to the above system, the sequential adjusting system reduces the time required for the adjustment by limiting the range of parameter adjustment. As shown in FIG. 2B, according to the sequential adjusting system, at first simulation relating to a first parameter shown in the X axis is carried out for five round points along the X axis based on the current parameter point $\alpha$ which has been delivered from the individuality supporting unit SP or which is a result of a few adjustments, so that an optimum point $\beta$ for the first parameter is selected. Then simulation relating to a second parameter is carried out for four triangular points other than the point $\beta$ along the Y axis around the point $\beta$, so that an optimum point $\gamma$ for the second parameter is selected. Last, simulation relating to a third parameter is carried out for four square points other than the point $\gamma$ along the Z axis around the point $\gamma$, so that an optimum point $\delta$ for the third parameter is selected. By carrying out the sequential adjustment of each parameter as described above, the number of simulation becomes 13 as the two points which are duplicated can be deducted.

$$5+(5-1)+(5-1)=13 \quad (3)$$

According to this method, automatic adjusting for the seven types of traffic mode can be done within less than one day time.

$$13\times10\times7=910 \text{ minutes} \quad (4)$$

Further, when the number of variable parameters increases by n times, the time required for automatic adjusting can be restricted to the order of n times. Therefore, this system can be sufficiently applied even if the number of parameters to be adjusted increases.

One embodiment of the present invention for realizing the above sequential adjusting system will be explained below with reference to FIGS. 3 to 21. The functional structure will be explained first, followed by the explanation of the processing and the contents of each data table.

Figure 3:
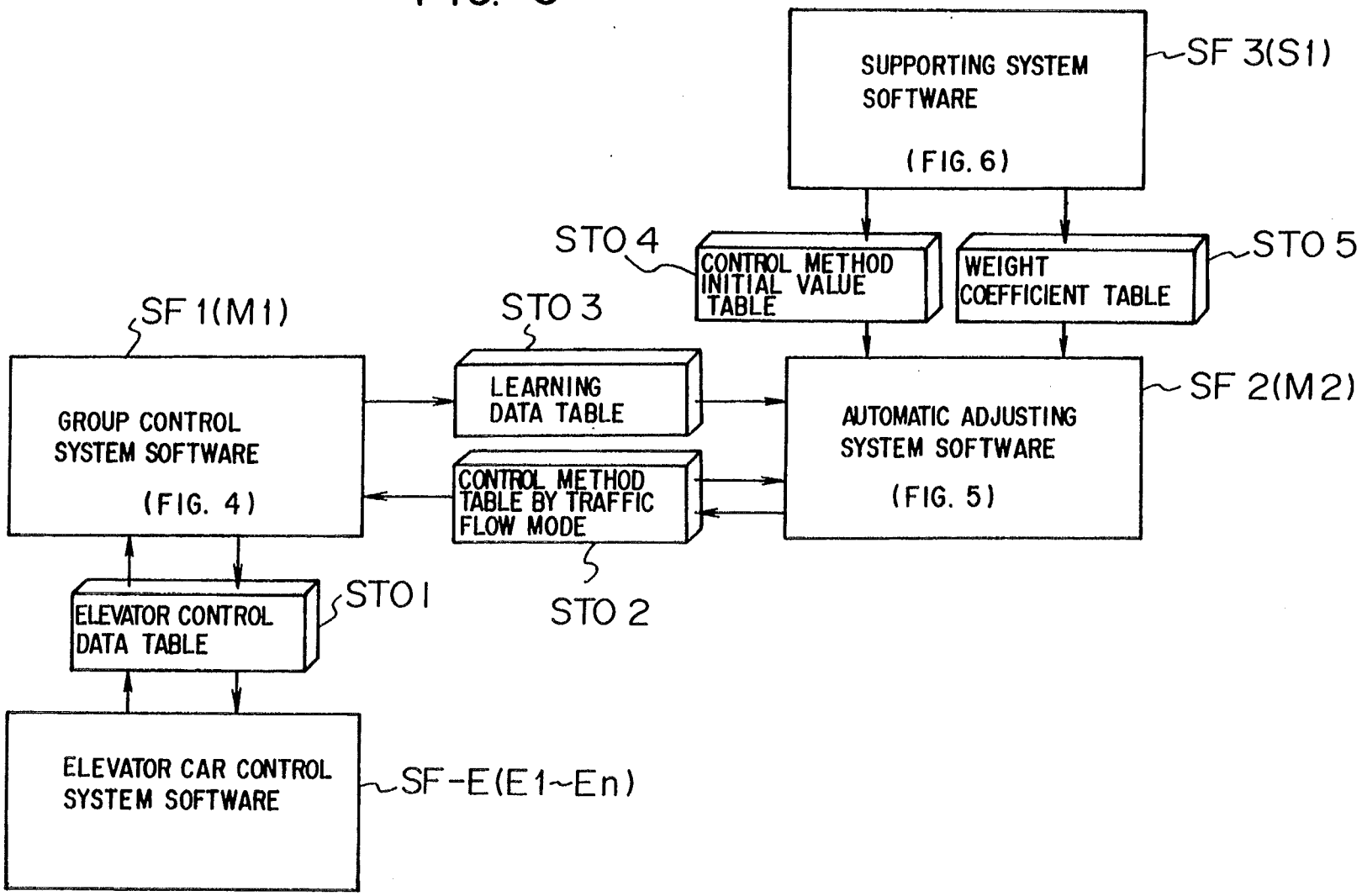
FIGS. 3 to 6 are functional block configuration diagrams for each portion of the group control elevator system shown in FIG. 1.

FIG. 3 is a large classification structure diagram of the functions of the system corresponding to each microcomputer.

An elevator car control system software SF-E is a software for managing each of elevator cars 1 to n and for operating the elevator cars in accordance with instruction of the group control unit. This software is executed by elevator car control microcomputers $E_l$ to $E_n$.

A group control system software $SF_1$ is a software for executing actual group control (allocation of elevator cars) and is used by a group control microcomputer M1.

The group control system software $SF_1$ and the elevator car control system software SF-E exchange information with each other through an elevator control table ST01.

An automatic adjustment system software $SF_2$ has a function which is a key function of the present invention and is executed by an automatic adjusting microcomputer M2.

The automatic adjustment system software $SF_2$ and the group control system software $SF_1$ exchange information with each other through a control method table by traffic flow mode $ST_{02}$ and a learning data table $ST_{03}$.

A supporting system software $SF_3$ receives users' requests such as a request for a quick elevator car service or a request for a noncrowded elevator car service at the cost of a slow service, etc. and numerically expresses these requests and decides an initial value for a control method which meets the users' requests. This function is executed by a control method deciding microcomputer S1 within the individuality supporting unit SP.

The supporting system software $SF_3$ and the automatic adjustment system software $SF_2$ exchange information with each other through a control method initial value table $ST_{04}$ and a weight coefficient table $ST_{05}$.

Figure 4:
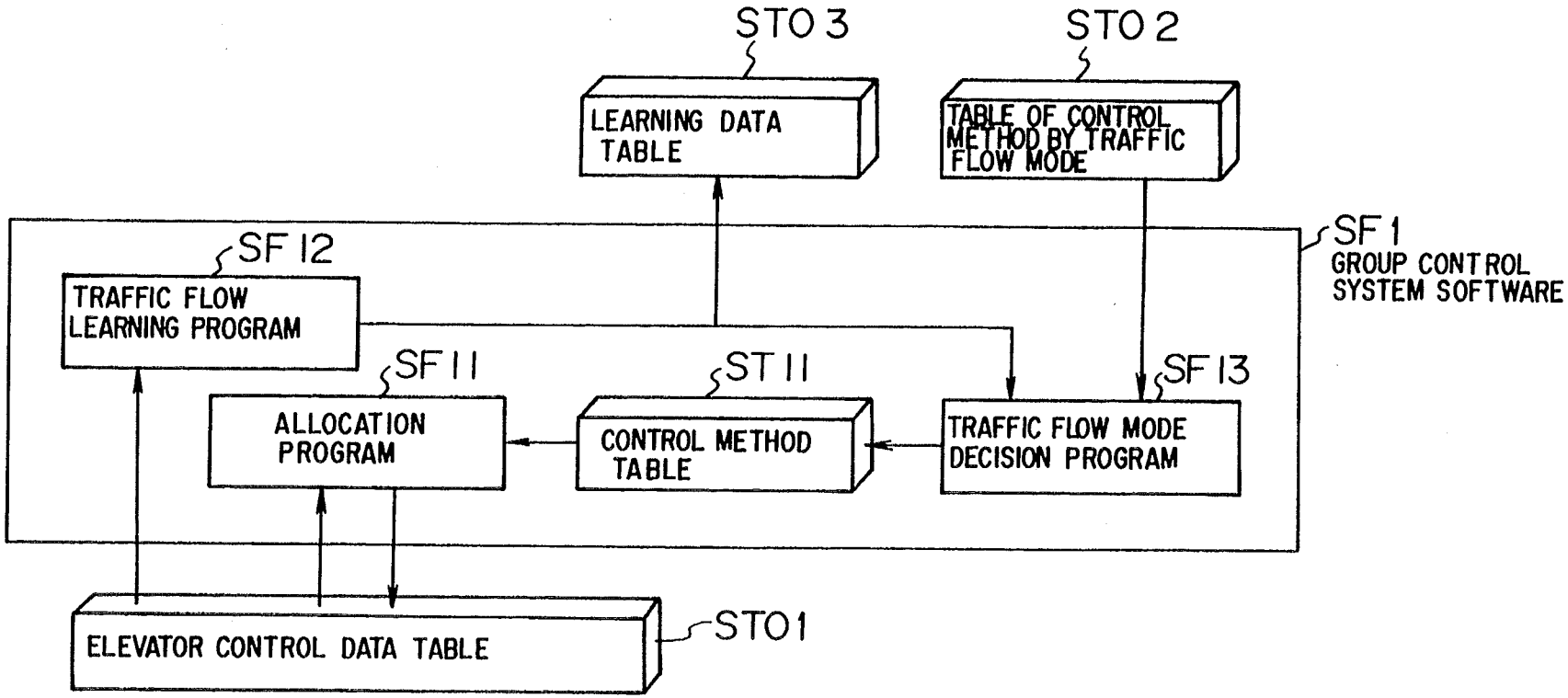

FIG. 4 is a software structure diagram inside the group control system software $SF_1$.

The group control system softwared $SF_1$ comprises three programs of an allocation execution program SF11, a traffic flow learning program $SF_{12}$ and a traffic flow mode decision program $SF_{13}$, and one data table of a control method table $ST_{11}$.

The allocation execution program $SF_{11}$ allocates an elevator car to an elevator hall in response to a car call at the elevator hall, by using a control parameter given to the control method table $ST_{11}$.

The traffic flow learning program $SF_{12}$ learns a traffic flow based on information of the elevator control data table $ST_{01}$, and gives the result of the learning to the traffic flow mode decision program $SF_{13}$ and the learning data table $ST_{03}$.

In this case, the traffic flow mode decision program $SF_{13}$ has a function of deciding a traffic flow to which demand for elevator car service belongs.

The traffic flow mode decision program $SF_{13}$ decides a traffic flow mode such as an office starting time zone or a normal office time zone which is a characteristic of the traffic flow, based on the latest learned data of the traffic flow learning program $SF_{12}$, selects a control method corresponding to the decided traffic flow mode from the control method table by traffic flow mode $ST_{02}$, and sets the selected control method to a control method table $ST_{11}$ which is a table of parameters using an actual group control.

Figure 5:
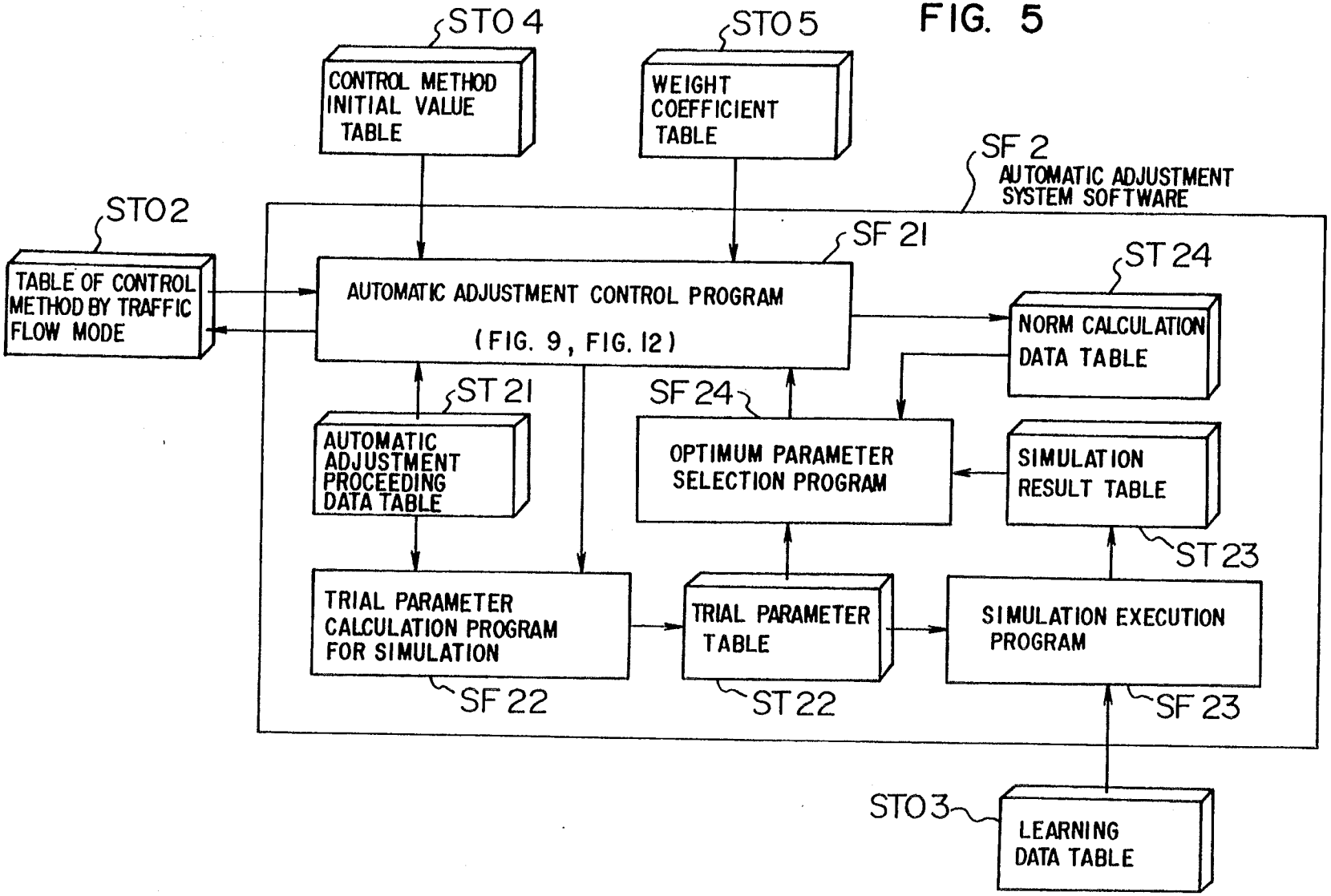

FIG. 5 is a software structure diagram of the inside of the automatic adjustment system software $SF_2$.

The automatic adjustment system software $SF_2$ comprises four programs of an automatic adjustment control program $SF_{21}$, a simulation trial parameter calculation program $SF_{22}$, a simulation execution program $SF_{23}$ and an optimum parameter selection program $SF_{24}$, and four data tables of an automatic adjustment proceeding data table $ST_{21}$, a trial parameter table $ST_{22}$, a simulation result table $ST_{23}$ and a norm calculation data table $ST_{24}$.

In this case, the automatic adjustment system software $SF_2$ has the following function: (1) a function of adjusting stored variable parameters; (2) a function of sequentially adjusting a plurality of variable parameters in accordance with stored sequence; (3) a function of sequentially adjusting variable parameters; and (4) a function of automatically adjusting variable parameters.

The automatic adjustment control program $SF_{21}$ is a program which controls proceeding of automatic adjustment by data of the automatic adjustment proceeding data table $ST_{21}$ structuring a storage unit for variable parameters (items) to be adjusted and an adjustment sequence storage unit therefor, and which controls as interface between the control method table by external traffic flow mode $ST_{02}$, the control method initial value table $ST_{04}$ and the weight coefficient table $ST_{05}$.

As described above, the automatic adjustment proceeding data table $ST_{21}$ includes the storage unit for variable parameters (items) to be adjusted and the adjustment sequence storage unit therefor. Details of this table will be explained later.

Further, the automatic adjustment proceeding data table $ST_{21}$ has the following function: (1) a function of storing variable parameters to be adjusted which have been preset for each combination of a target and a traffic flow; and (2) a function of storing an adjustment sequence among a plurality of variable parameters which have been preset for each combination of a target and a traffic flow.

The simulation trial parameter calculation program $SF_{22}$ corresponds to a candidate parameter preparation unit, and calculates trial parameters of the sequential adjustment system by data of the automatic adjustment proceeding data table and sets the result to the trial parameter table $ST_{22}$.

The simulation execution program $SF_{23}$ corresponds to a control result estimating unit, and carries out simulation of trial parameters of the trial parameter table $ST_{22}$ based on the result of the learning data table $ST_{03}$ and writes the result in the simulation result table $ST_{23}$.

The optimum parameter selection program $SF_{24}$ corresponds to an optimum control method selection unit, and calculates "weighted norm" to be described later by data of the simulation result table $ST_{23}$ and the norm (deviation) calculating data table $ST_{24}$ and selects an optimum control parameter from the trial parameter table $ST_{22}$ based on the result of a comparison of the calculated weight norm.

Figure 6:
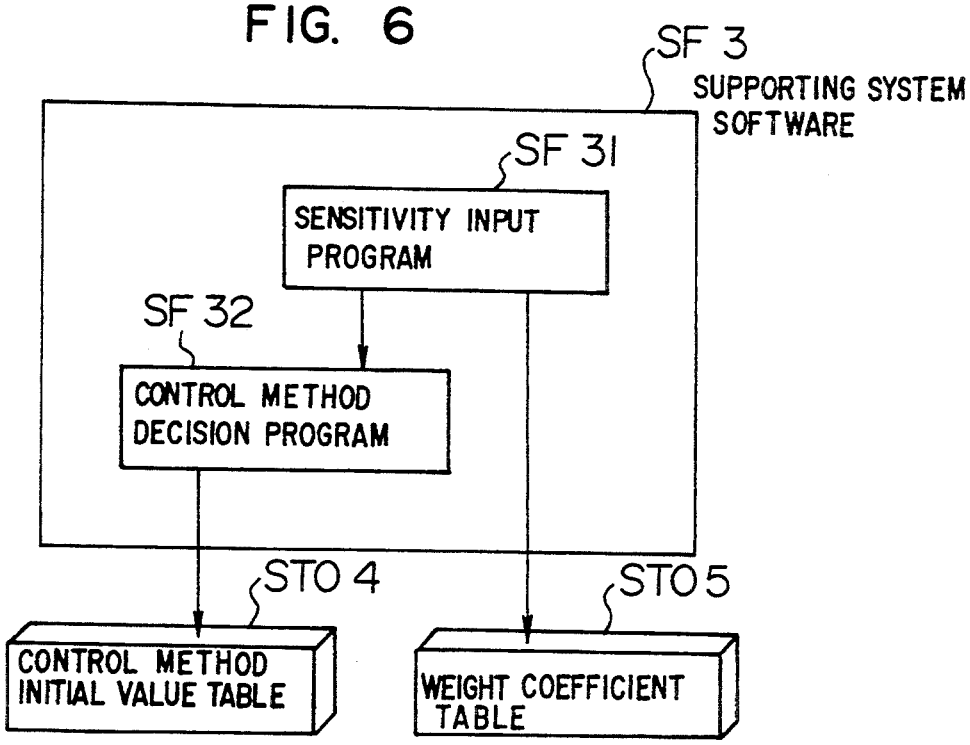
Figure 8:
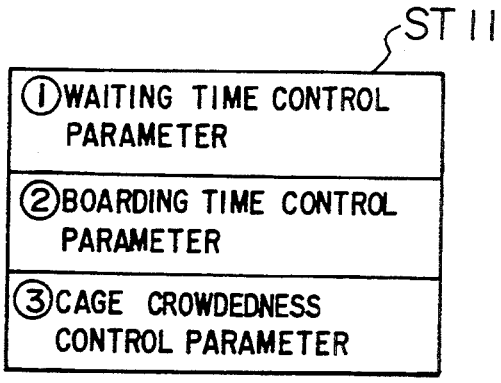
FIG. 8 is a control parameter table used in steps in FIG. 7.

FIG. 6 is a software structure diagram of the inside of the supporting system software $SF_3$.

The supporting system software $SF_3$ is designed to give weight coefficients which represent users' requests in numerical values. For example, it is possible to select weight of ① waiting time, ② boarding time and ③ crowdedness of an elevator cage at the ratio of 30:45:25 respectively.

The supporting system software $SF_3$ comprises two programs of a sensitivity input program $SF_{31}$ and a control method decision program $SF_{32}$.

The sensitivity input program $SF_{31}$ receives requests of elevator car users, converts the requests into numerical values called "weight coefficient" and sets the result to the weight coefficient table $ST_{05}$.

The sensitivity input program $SF_{31}$ also has a function for inputting a target for elevator control performance.

The control method decision program $SF_{32}$ analyzes a control method for expressing requests of elevator car users in numerical values and sets the values in the control method initial value table $ST_{04}$.

Next, processing of programs and contents of the data tables necessary for executing one embodiment of the present invention will be explained with reference to FIGS. 7 to 21. In the following explanation of a program, it has been assumed that the program is divided into a plurality of tasks which are controlled for execution by a system program for efficient control of the program, the so-called real-time operating system. Therefore, starting or stopping of the program can be done freely by other program or the system timer. For the group control system software $SF_1$, the corresponding portion of the JP-A-58-52162 or other known method can be used. For the supporting system software $SF_3$, JP-A-1-192682 or other invention can be applied. Therefore, description of these known arts is omitted here, and only change points which are necessary to achieve the present invention will be explained with reference to FIGS. 7 and 8.

Figure 7:
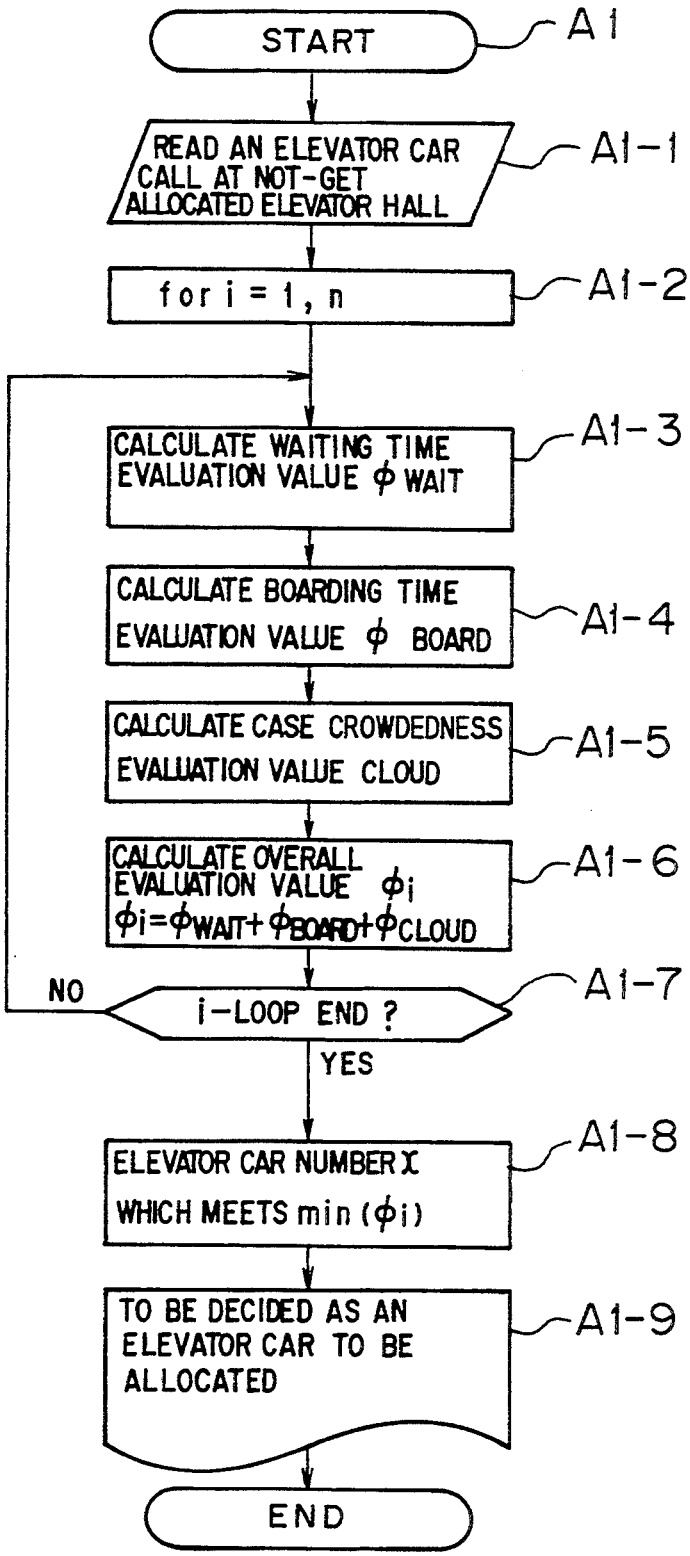
FIG. 7 is a flow chart for the group control. elevator control program used in the present invention.

FIG. 7 is a program flow chart A1 of the allocation execution program $SF_{11}$ of the group control system software $SF_1$ which is necessary to control three targets of ① reduction in waiting time, ② reduction in boarding time and ③ reduction in crowdedness of an elevator cage as the target items of group control. It is assumed that the program A1 is periodically started at every 0.1 second, for example, even if there is no elevator car call at any elevator hall. However, it may also be arranged such that the program A1 is occasionally started when there has arisen an elevator car call at any elevator hall.

At Step A1-1, an elevator car call signal sent from an elevator car hall to which no car has been allocated yet is read from the elevator control data table $ST_{01}$. Step A1-2 and Step A1-7 are a loop processing relating to all the elevator cars. At Step A1-3 within the loop, a waiting time for a corresponding elevator car number i is estimated by calculation and a wait time evaluation time $\phi$ wait is calculated. Next, at Step A1-4, a boarding time of the corresponding elevator car number i is estimated by calculation and a boarding time evaluation value $\phi$ board is calculated. Then, at Step A1-5, crowdedness of the elevator cage of the elevator car number i is estimated by calculation and a cage crowdedness evaluation value $\phi$ crowd is calculated. For the calculation of the evaluation values $\phi$ at the Steps A1-3 to A1-5, current variable control parameters set in the control method table $ST_{11}$ are used.

As an example of the control parameter for the (1) waiting time, there is "an area value a" which shows a degree of considering an influence of an elevator car call for which a decision has already been made that a car-stop service is going to be provided. The area value is expressed as follows:

$$\phi\ \text{wait} = WT - a \times a' \tag{5}$$

WT: estimated waiting time
a: an area value
a': an evaluation value of an elevator car stop at a near place It is possible to change the degree of consideration to be given to an elevator car call at a near place, by adjusting the area value a.

As an example of the control parameter for the (2) boarding time, there is "a car boarding coefficient b" which is a multiplication factor to be applied to an estimated longest response time to an elevator car call.

$$\phi\ \text{board} = b \times RT \tag{6}$$

b: a boarding coefficient
RT: an estimated longest response time to an elevator car call It is possible to change the degree of consideration to be given to a boarding time at the time of allocating an elevator car, by adjusting the value of the b.

As an example of the control parameter for the (3) elevator cage crowdedness, there is "a threshold value C" which is an allocation limit to be provided to the multiplier within the cage.

$$\phi\ \text{crowd} = \begin{cases} 0 (CD \leqq C) \\ \text{a specific value } (CD > C) \end{cases} \tag{7, 8}$$

*CD: a boarding factor*
*C: a threshold value*

It is possible to reflect the degree of the cage crowdedness to an elevator car allocation, by adjusting the value of the threshold value C.

At Step A1-6, an overall evaluation value $\phi i$ of the corresponding elevator car number i is calculated as follows by using each of the calculated evaluation values $\phi$.

$$\phi i = \phi\text{wait} + \phi\text{board} + \phi\text{crowd} \tag{9}$$

At Step A1-7, an end of the loop relating to the elevator car number i is monitored, and when the loop has been finished, an elevator car which has the minimum overall evaluation value $\phi i$ or which has the best overall evaluation value is decided as the elevator car to be allocated. At Step A1-9, an allocation signal is written to the elevator control data table and the processing is terminated.

It is possible to apply the method of Japanese Patent No. 1340752 and others to the processing of the above Step A1-4 and the method of JP-A-1-317969 and others to the processing of the Step A1-5. The control method table ST11 used in the Steps A1-3 to A1-5 comprises (1) a variable parameter relating to the waiting time control such as the area value, for example, (2) a variable parameter relating to the boarding time control such as the multiplication factor (coefficient), and (3) a variable parameter relating to the cage crowdedness control such as a boarding rate permissible value (threshold value).

The processing of the automatic adjustment system software $SF_2$ used in the present invention will be explained below with reference to FIGS. 9 to 21.

Figure 9:
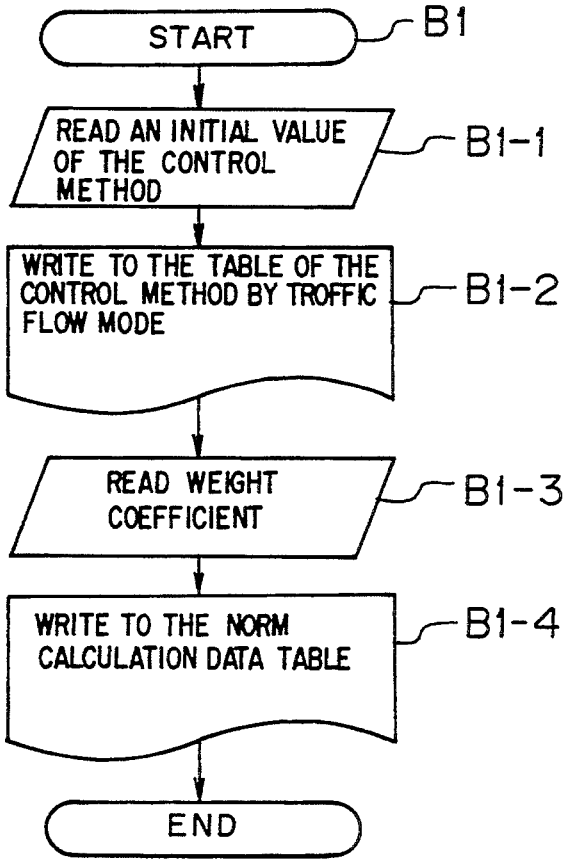
FIG. 9 is a flow chart for a supporting system—automatic adjustment system program used in the present invention.

FIG. 9 is a flow chart B1 of the interface program between the automatic adjustment system and the supporting system of the automatic adjustment control program $SF_{21}$. The program B1 is started when it receives data from the supporting system.

At Step B1-1, the control method initial value table ST04 which has been analyzed and decided by the individuality supporting unit SP is read, and at Step B1-2, the control table ST02 is updated. At Step B1-3, the weight coefficient table ST05 which is a table of weighted numerical values prepared based on users' requests is read, and at Step B1-4, data is written in a corresponding portion of the norm calculation data table ST24.

Figure 10:
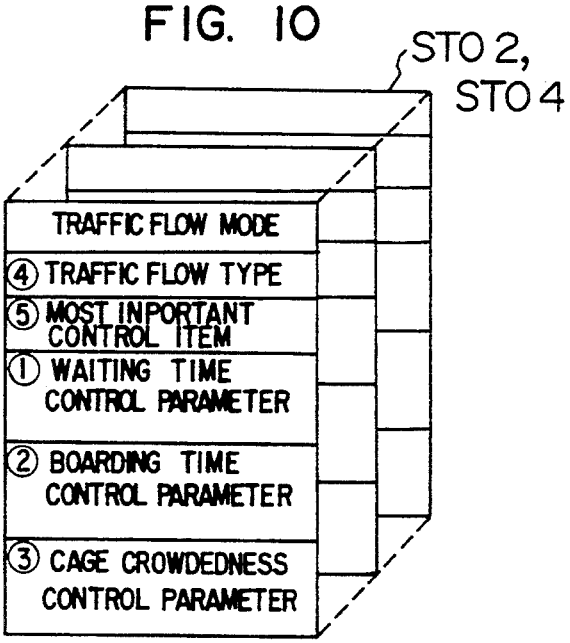
FIG. 10 shows contents of an initial value table of a control method table and control method by traffic flow mode used in the present invention.

FIG. 10 shows contents of the control method table by traffic flow mode ST02 and the control method initial value table ST04. The table stores (4) a traffic flow type, (5) the most important control item, (1) a waiting time control parameter, (2) a boarding time control parameter and (3) a cage crowdedness control parameter, for each traffic flow mode such as an office starting time zone and a normal office time zone, respectively.

The (4) traffic flow type in this case shows a large classification of traffic flows. In the present embodiment, by considering an influence to automatic adjustment of the control method parameter, traffic flows are classified into four types including a first type that is a time zone of an extreme demand for elevator cars at a specific floor such as an office starting time zone and a latter half of lunch hour zone, a second type that is a time zone of an extreme demand for moving to a specific floor such as a first half of lunch hour zone and an office closing time zone, and third and fourth types that are other types. A large demand for a move between general floors is classified as the third type and small demand for a move between general floors is classified as the fourth type. Traffic flow types are set in advance for each traffic flow mode by designers.

The (5) most important control item is a control item having the largest value of weight coefficient among users' requests, to show a representative request of the users. If the weight coefficients for all the items are the same, degree of importance of all the three items is regarded to be equal.

Figure 11:
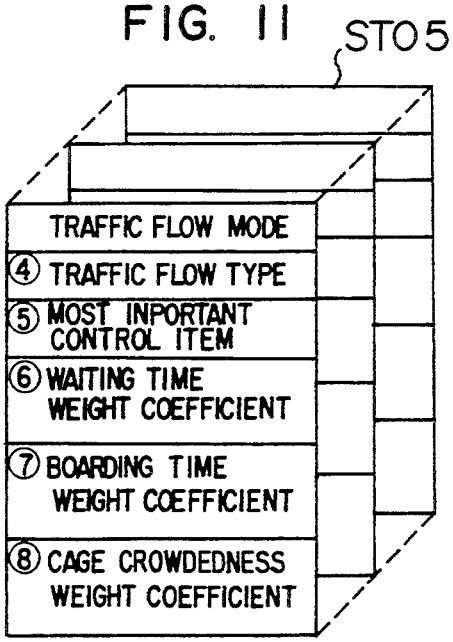
FIG. 11 shows contents of a weight coefficient table.

FIG. 11 shows the contents of the weight coefficient table ST05. The table stores (4) a traffic flow type, (5) the most important control item, (6) a waiting time weight coefficient, (7) a boarding time weight coefficient and (8) an elevator cage crowdedness weight coefficient, for each traffic mode respectively.

Values of the weight coefficients reflect users' requests and they are used to calculate weighted norm to be described later.

Figure 12:
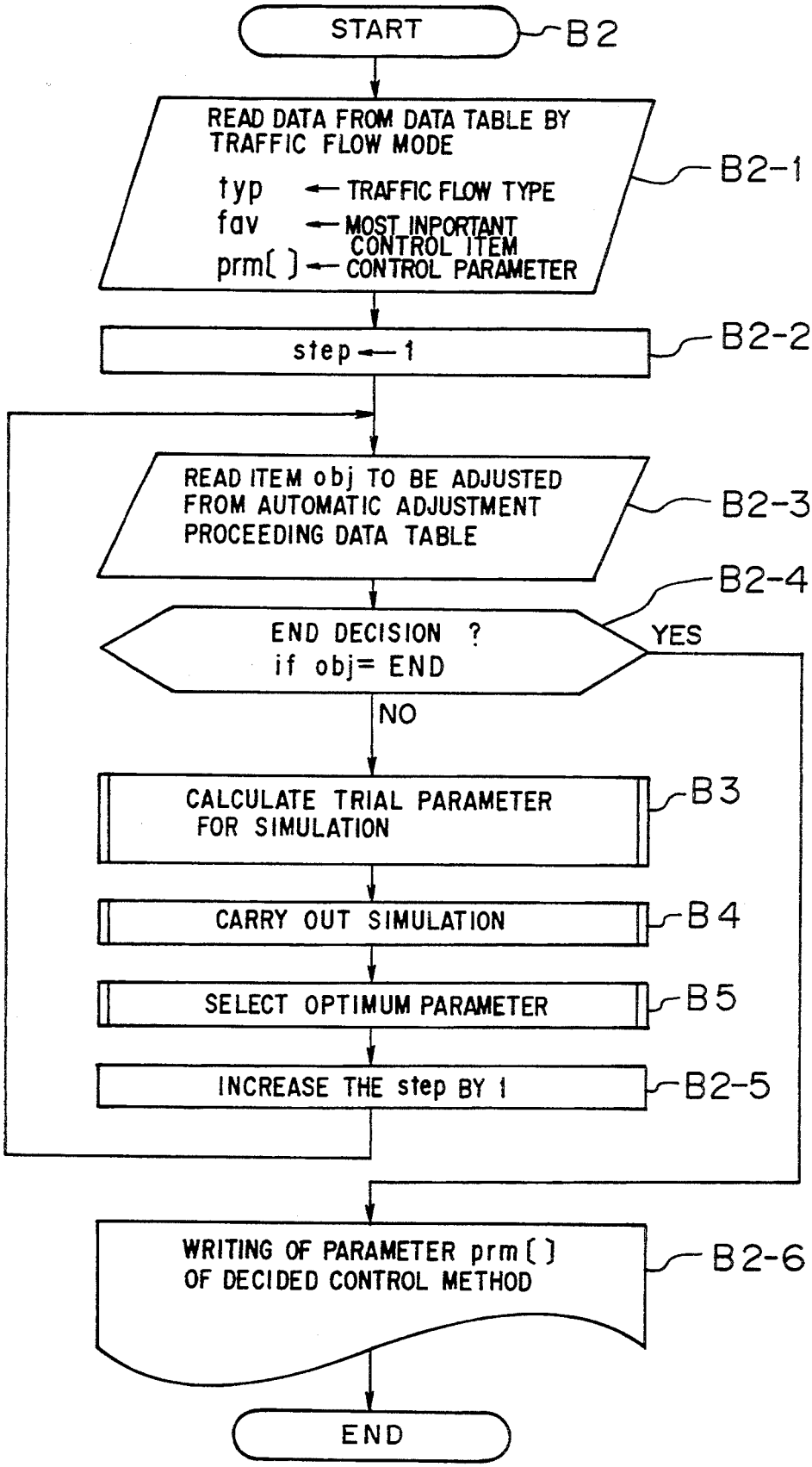
FIG. 12 is an automatic adjustment control program used in the present invention.

FIG. 12 is a flow chart B2 of a program which manages automatic adjustment proceeding of the automatic adjustment control program $SF_{21}$ and handles data exchanges with the control method table by traffic flow mode ST02. The program B2 is started by a trigger signal applied from the outside. Time information (20 hours every day), an ending signal of the program B2 itself and a signal from the result of learning such as a storage quantity of learned data and a changed quantity of learned data, can be utilized as a trigger signal.

At Step B2-1, a traffic flow type, the most important control item and a control parameter are read into typ, fav and prm [ ] respectively for one traffic flow mode from the control method table ST02 by traffic flow mode ST02. In this case, the typ and fav designate names of variables on the memory and prm [ ] designates a name of a layout on the memory. In the following explanation, it is assumed that when a layout name is expressed by itself or when it is expressed a layout name +[ ], all the contents of the layout are expressed. At Step B2-2, 1 is set to a variable step which shows a degree of proceeding of automatic adjustment. At Step B2-3, items to be adjusted corresponding to the traffic flow type typ, the most important control item fav and the degree of proceeding step, are read into obj from the automatic adjustment proceeding data table ST21. At Step B2-4, the item to be adjusted obj is checked, and if obj is not an end signal END, a simulation trial parameter calculation subroutine B3, a simulation execution subroutine B4 and an optimum parameter selection subroutine B5 are executed. At Step B2-5, the degree of proceeding .step is advanced by 1, and the processing starting from the Step B2-3 is repeated. When a decision at Step B2-4 is Yes, the processing goes to Step B2-6, and the control method parameter prm [ ] that has been decided is updated in the control method table by traffic flow mode ST02.

The sequential adjustment system which has been explained with reference to FIG. 2 is realized by the processing of the present flow chart which repeats the process of determining an item obj to be adjusted (B2-3) and selecting an optimum parameter relating to the item obj to be adjusted (B5) for the set steps (B2-2 and B2-5 ).

Variable parameter items to be adjusted which are important for executing the sequential adjustment system and the adjustment sequence therefor are stored in the automatic adjustment proceeding data table ST21.

FIGS. 13A to 13C show the contents of the automatic adjustment proceeding data table ST21. The automatic adjustment proceeding data table $ST_{21}$ comprises ST21A which is used in the program B2 and ST21B which is used in the subroutine to be described later.

The table ST21A shown in FIG. 13A stores items to be adjusted at each step for each traffic flow mode and for each of the most important control items. If only two variable parameters are to be adjusted, an end signal END is set instead of the items to be adjusted in the Step 3. Similarly, if only one item is to be adjusted, an end signal END is set instead of the items to be adjusted in the Step 2 and Step 3. At the portion next to the storage of items to be adjusted at each Step 3 in the table ST21A, an end signal END is set.

An example of the contents of the storage of the table ST21A is shown in FIG. 13B. FIG. 13B shows an example of the case where (1) "an area value" is taken for the waiting time control parameter, (2) "a boarding coefficient" is taken for the boarding time control parameter, and (3) "a threshold value" is taken for the cage crowdedness control parameter. Variable parameter items to be adjusted and their sequence are different depending on users' requests and combinations of traffic flows. For example, the table indicates that in order to reduce an elevator car waiting time during a normal office time zone, the area value and the threshold value should be adjusted, and an elevator car boarding coefficient has little meaning in this case. The table also indicates that it is effective to adjust in the sequence of "the area value→the threshold value" during the normal office time zone while it is effective to adjust in the sequence of "the area value→the threshold value→the boarding coefficient" when the traffic flow is in the early half of the lunch time zone, even if the waiting time has a high priority for both cases. In contrast to the above cases, the table also indicates that it is effective to adjust in the sequence of "the threshold value→the area value→the boarding coefficient" if users' requests have a high priority in the reduction of an elevator cage crowdedness during the same normal office time zone. As described above, items to be adjusted and their sequence are different depending on users' requests or traffic flows. These contents are set in advance by specialists such as designers of a group control elevator system or other persons.

The table ST21B shown in FIG. 13C stores (9) a maximum value max of a variable parameter, 10 a minimum value min of a variable parameter, 11 a number of trials try for showing the number of trials carried out around the current parameter and 12 a parameter width wth for setting a trial parameter, for each item to be adjusted.

By setting a maximum value max and a minimum value min, it is possible to specify a range of a value of the parameter, such as, for example, 40% to 90% as a boarding rate for the cage crowdedness control parameter. By setting a number of traials to be carried out around the current parameter, it is possible to set details such as three points before and after the current waiting time control parameter (totalling seven points) and roughly one point before and after the current cage crowdedness control parameter (totalling three points).

Figure 14:
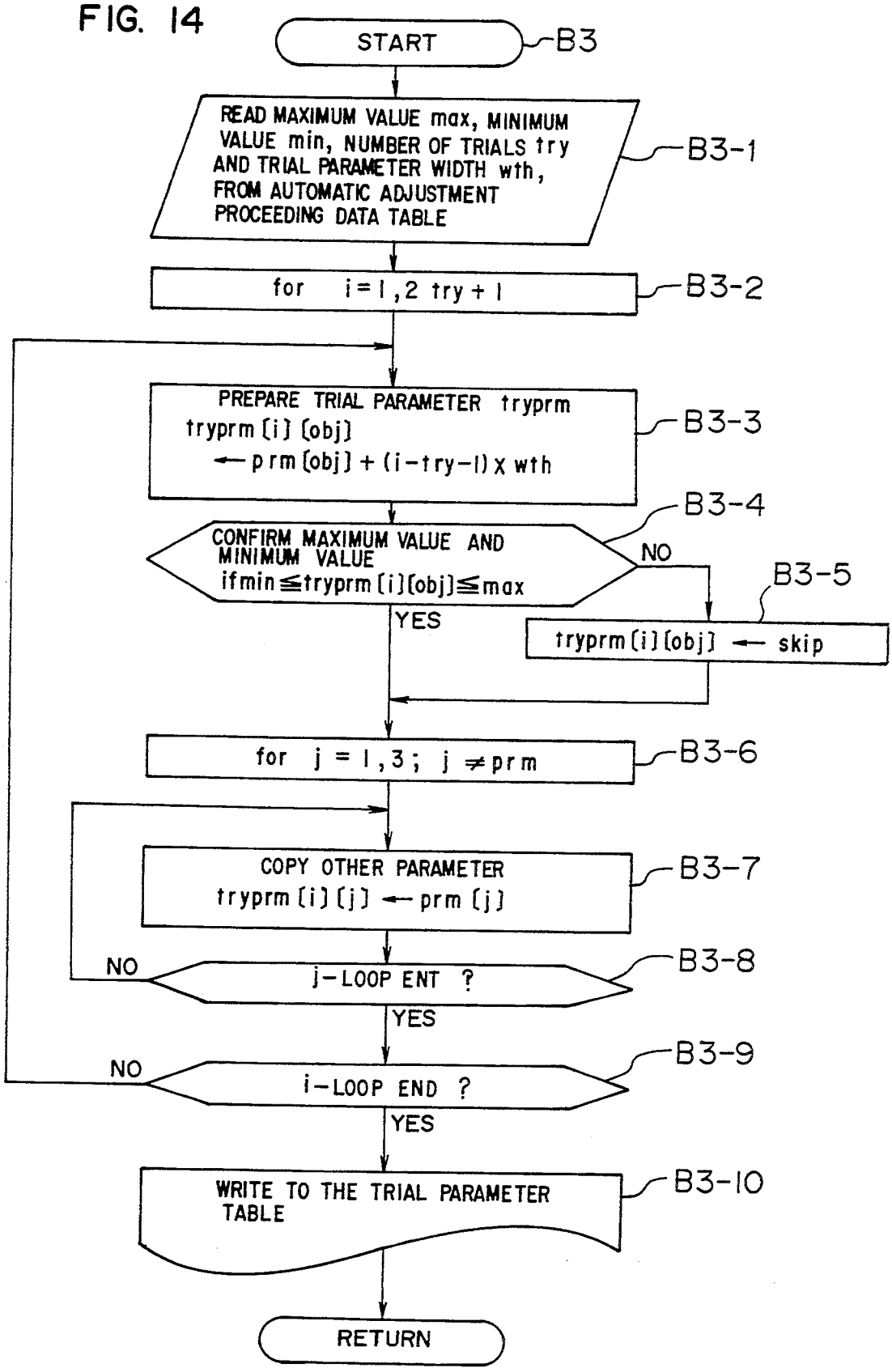
FIG. 14 is a flow chart for a trial parameter calculation program used in the present invention.

FIG. 14 is a flow chart for a simulation trial parameter calculation program SF22 (corresponding to the subroutine B3) to be used in the present invention.

At Step B3-1, contents of the ST21B corresponding to an item to be adjusted are read from the automatic adjustment proceding data table ST21. Step B3-2 and Step B3-9 are a loop processing relating to the number of trial parameters. A trial simulation is carried out for each try point before and after the current parameter and for the current parameter, so that the total number of trial simulation is (2 try+1). At Step B3-2, a trial parameter try prm [i][obj] is prepared centered around the current parameter prm [obj], by using the trial parameter width wth. At Step B3-4, a maximum value and a minimum value are confirmed, and if a value is out of the range, the contents of the trial parameter try prm

[i][obj] are set to a signal skip which shows simulation is not appropriate at Step B3-5. In the loop processing at Steps B3-6, B3-7 and B3-8, a variable parameter other than the item to be adjusted obj is copied to the trial parameter. If the loop is an end by the decision at Step B3-9, the trial parameter try prm [ ] prepared at Step B3-10 is written in the trial parameter table ST22, and the processing returns to the original program.

Figure 15:
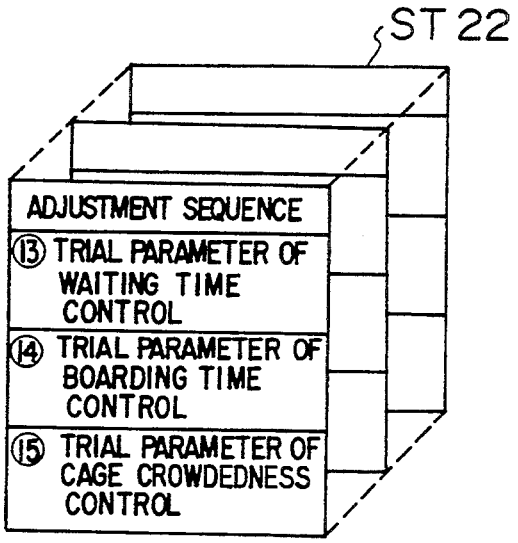
FIG. 15 is a trial parameter table used in steps in FIG. 14.

As shown in FIG. 15, the trial parameter table $ST_{22}$ stores trial parameters for each item for each adjustment sequence, that is, 13 a trial parameter of waiting time control, 14 a trial parameter for boarding time control and 15 a trial parameter for cage crowdedness control.

Figure 16:
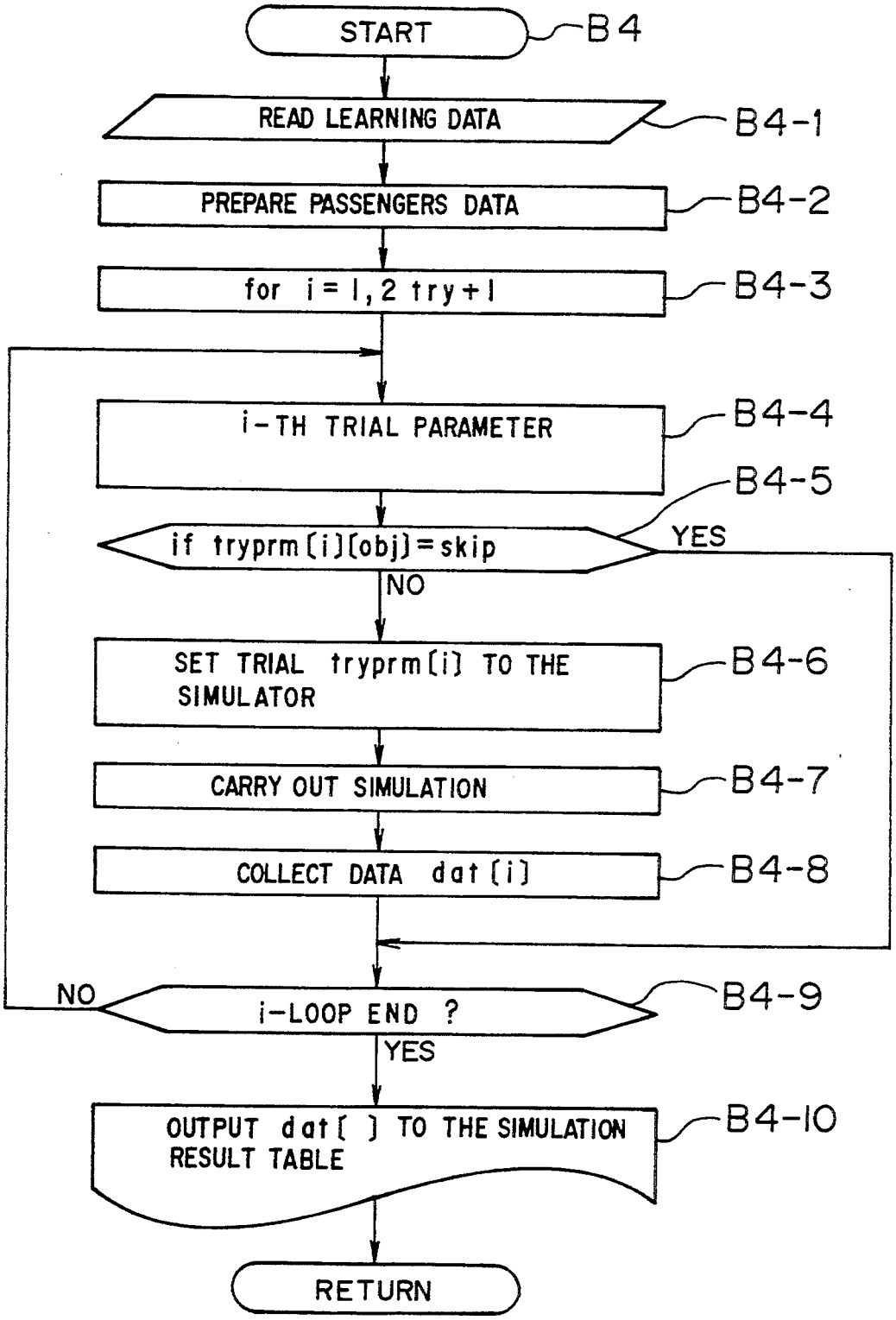
FIG. 16 is a flow chart for a simulation execution program used in the present invention.

FIG. 16 is a flow chart of the simulation execution program SF23 (the subroutine B4) which is used in the present invention.

At Step B4-1, learning data of the traffic flow mode which is to be adjust at present is read, and passenger data is prepared at Step B4-2. Steps B4-3 to B4-9 are a loop processing relating to the number of trial parameters. At Step B4-4, a trial parameter try prm [i] is read from the trial parameter table ST22. At Step B4-5, a simulation inappriate signal skip is confirmed for the trial parameter which has been read. If the trial parameter is not for the skip, the trial parameter try prm [i] set to the simulator at Step B4-6. At Step B4-7, simulation for the passengers prepared at the Step B4-2 is carried out, and at Step B4-8, result data dat [ ] of the simulation of waiting time, boarding time and cage crowdedness is collected. If the loop is an end by the decision at Step B4-9, the result data dat [ ] is outputted to the simulation result table ST23 at Step B4-10, and the processing returns to the original program.

In the subroutine B4, it is possible to use the method disclosed in JP-A-58-52162 or others for the detailed processings at the steps B4-1, B4-2 and B4-7.

Figure 17:
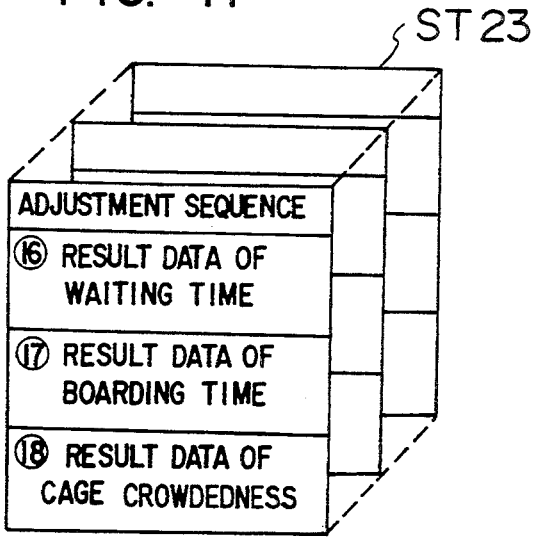
FIG. 17 is a result data table used in steps in FIG. 16.

As shown in FIG. 17, the simulation result table ST23 stores simulation result data for each item for each adjustment sequence, that is, 16 result data of waiting time, 17 result data of boarding time and 18 result data of cage crowdedness.

Figure 18:
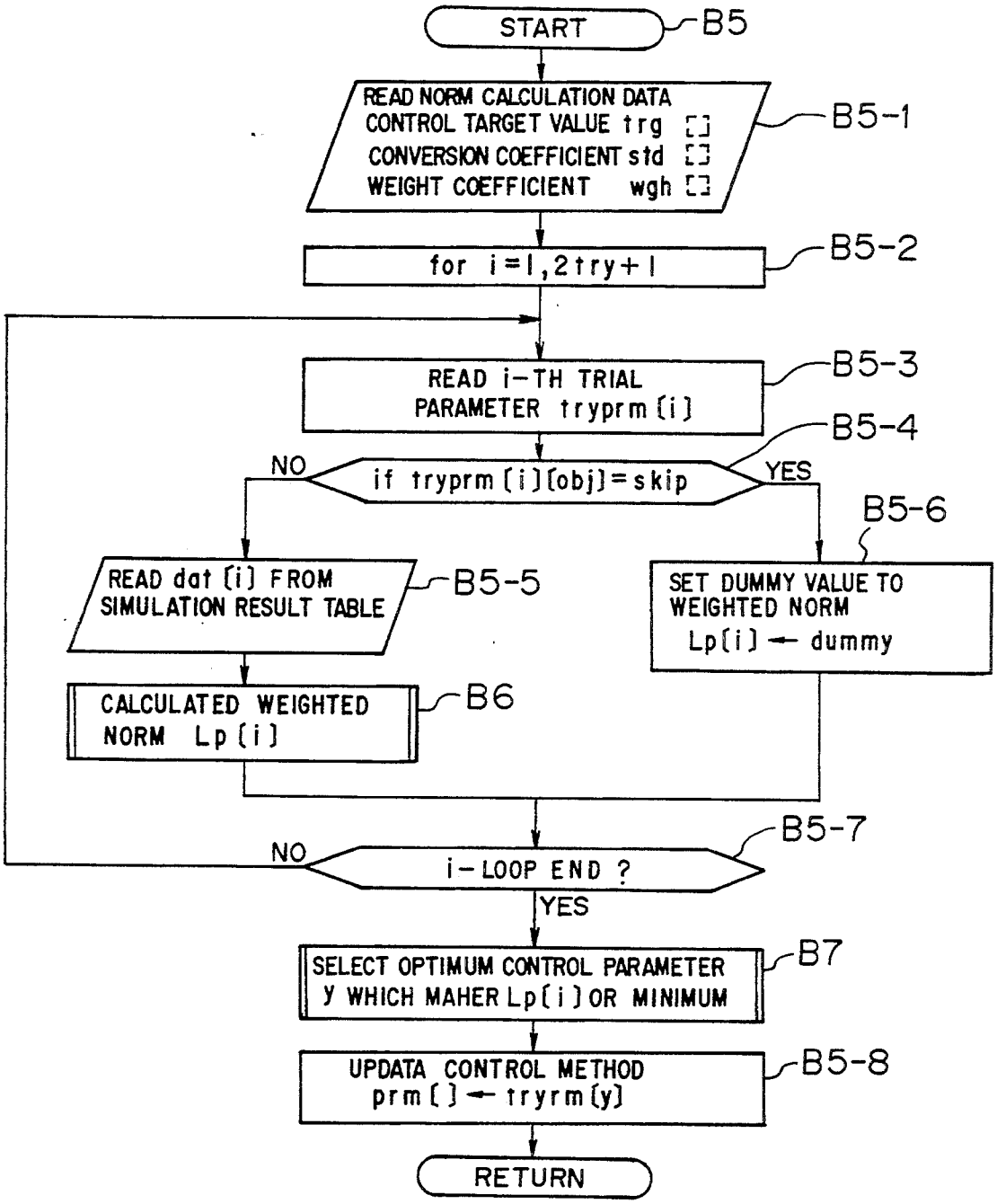
FIG. 18 is a flow chart for an optimum parameter selection program used in the present invention.

FIG. 18 is a flow chart of the optimum parameter selection program SF24 (the subroutine B5) which is used in the present invention.

At Step B5-1, as data for calculating weighted norm Lp [i] , a control target value is read into trg [ ], a conversion coefficient is read into std [ ] and a weight coefficient is read into wgh [ ] from the norm calculation data table ST24, respectively. Steps B5-2 to B5-7 are a loop processing relating to the number of trial parameters. At Step B5-3, a trial parameter tryprm [i] is read from the trial parameter table ST22. At Step B5-4, a simulation inappropriate signal skip is confirmed for the trial parameter that has been read, and the processing goes to Step B5-5 if the trial parameter is not for the skip. At the Step B5-5, a simulation result data dat [i] is read from the simulation result data table ST23. Based on the data read above, a weighted norm Lp [i] is calculated in a subroutine B6. When the simulation inappropriate signal skip has been detected at the Step B5-4, a large dummy value dummy in the weighted norm Lp [i] is set at Step B5-6. When the loop is an end by the decision at Step B5-7, the weighted norm Lp [i] is set to a minimum in a subroutine B7. In other words, i which gives an optimum variable control parameter to the current triffic flow is selected. At Step B5-8, the contents of the control method parameter prm [ ] are updated to an optimum parameter tryprm [i] that has been selected, and then the processing returns to the original program.

Figure 19:
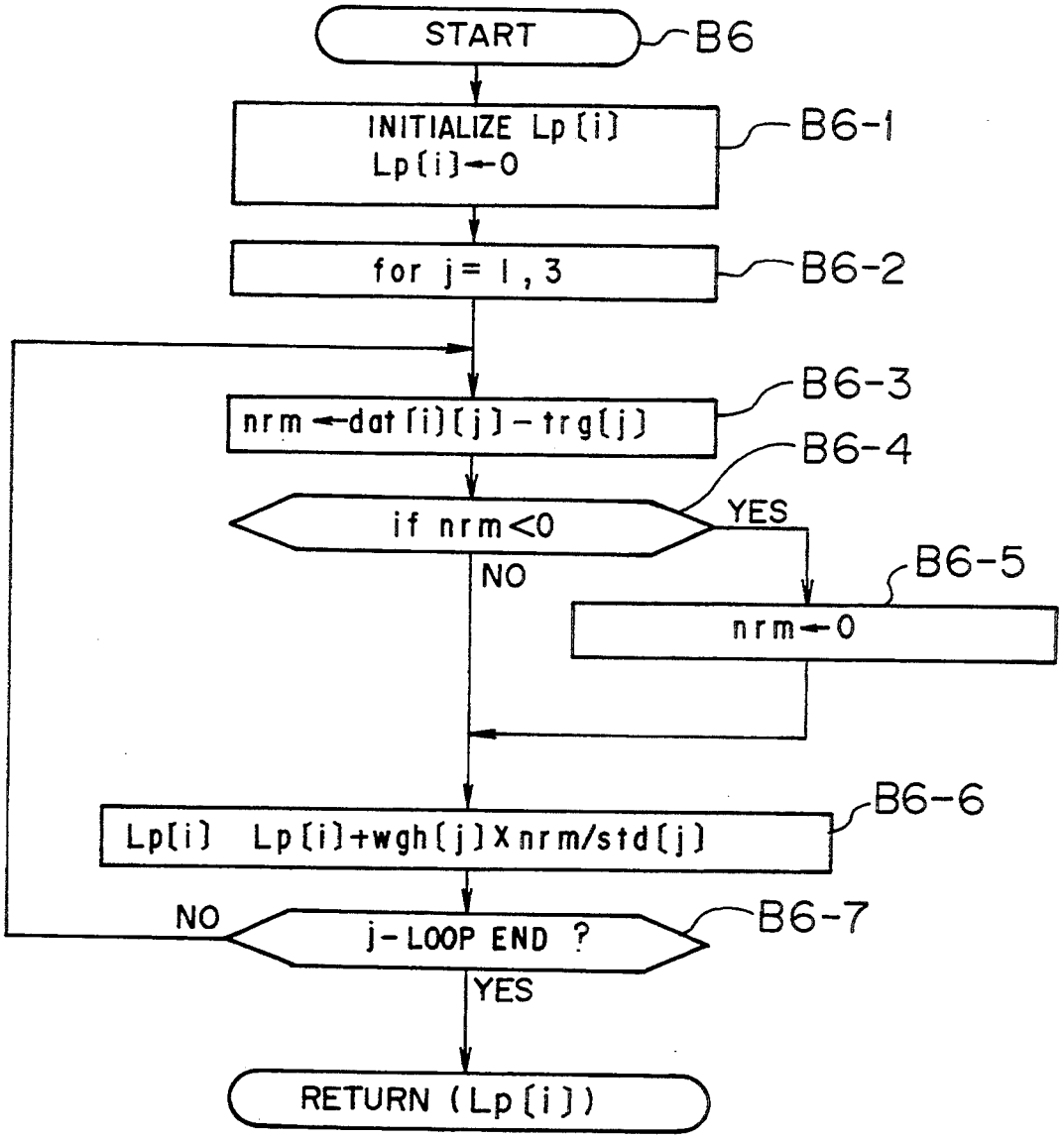
FIG. 19 is a flow chart for a norm calculation program used in the present invention.

FIG. 19 is a flow chart of the weighted norm calculation subroutine B6 which is used in the present invention. The weighted norm is obtained by multiplying a weight coefficient according to users' requests, to a norm which is calculated from the difference between a simulation result and a target value, and the result is totalled, to indicate a degree of closeness of the result to the users' requests. A result which is closest to the users' requests takes a small value of the weighted norm Lp and a result which is far from the users' requests takes a large value for the Lp. Therefore, a variable control parameter which takes the minimum value of the Lp is an optimum parameter to be obtained.

Figure 20A:
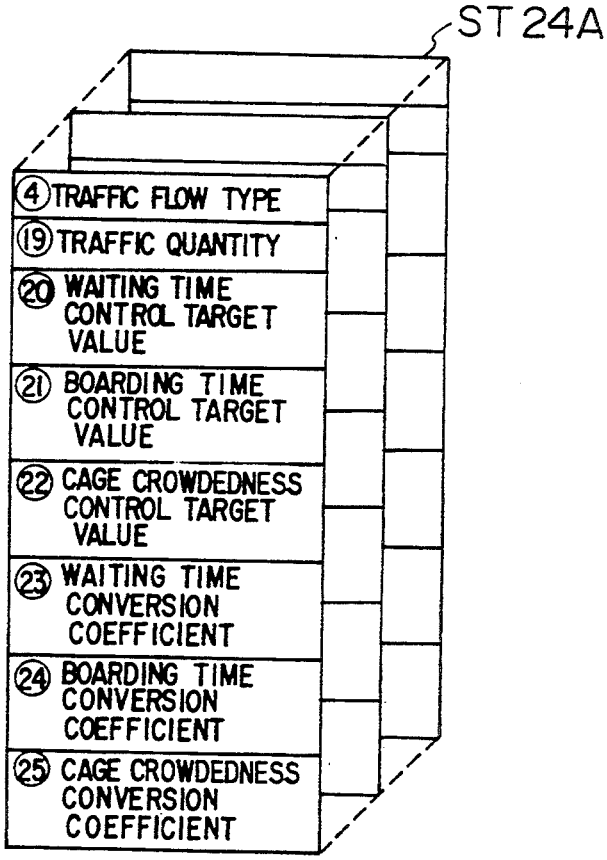
FIGS. 20A and 20B are norm calculation data tables used in steps in FIG. 19.
Figure 20B:
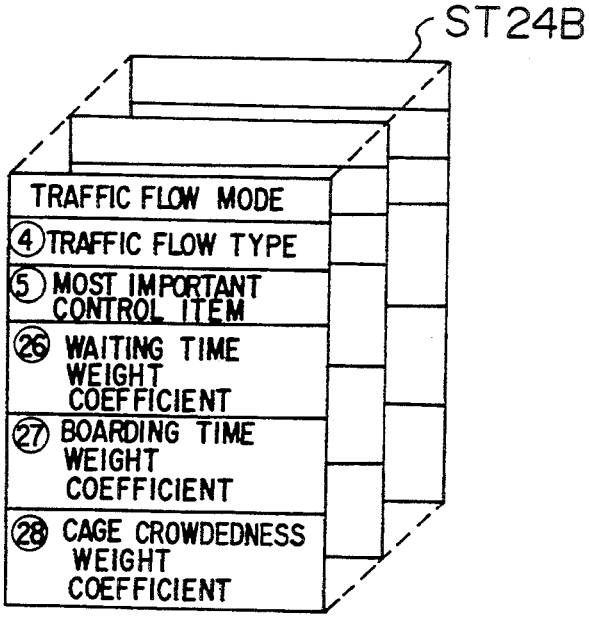

At first, at Step B6-1, a weighted norm Lp [i] corresponding to the trial parameter i is initialized. Steps B6-2 to B6-7 are a loop processing relating to a control target item. At Step B6-3, a difference is taken between the simulation results dat [i][j] and the control target value trg [j] and the difference is placed in a temporary variable nrm for storing the norm. At Step B6-4, the value of the norm is checked, and when the value is smaller than 0, or when the simulation result has achieved the control target value, the value of the nrm is set to 0 at Step B6-5. At Step B6-6, the norm nrm having various units such as second and % is set to be nondimensional by a conversion coefficient std [j] and is further weighted by a weight coefficient wgh [j] which shows users' requests in a numerical value, and the weighted result is accumulated in Lp [i]. The above processing is repeated, and when end has been decided at Step B6-7, the weight norm Lp [i] is returned to the original program. The contents of the norm calculation data table ST24 which are read at the Step B5-1 in FIG. 18 and used in the subroutine B6 in FIG. 19 are shown in FIG. 20.

The norm calculation data table ST24 comprises a table ST24A for storing a control target value trg and a conversion coefficient std and a table ST24B for storing a weight coefficient wgh.

The table ST24A stores a control target value for each control target item by (4) traffic flow type and by 19 traffic volume, that is, 20 a control target value of waiting time, 21 a control target value of boarding time, 22 a control target value of cage crowdedness and conversion coefficients of 23 a waiting time conversion coefficient, 24 a boarding time conversion coefficient and 25 a cage crowdedness conversion coefficient.

The table ST24B stores a weight coefficient for each control target item which is users' requests expressed in a numerical value for each traffic flow mode, and traffic flow types and the most important control item.

Figure 21:
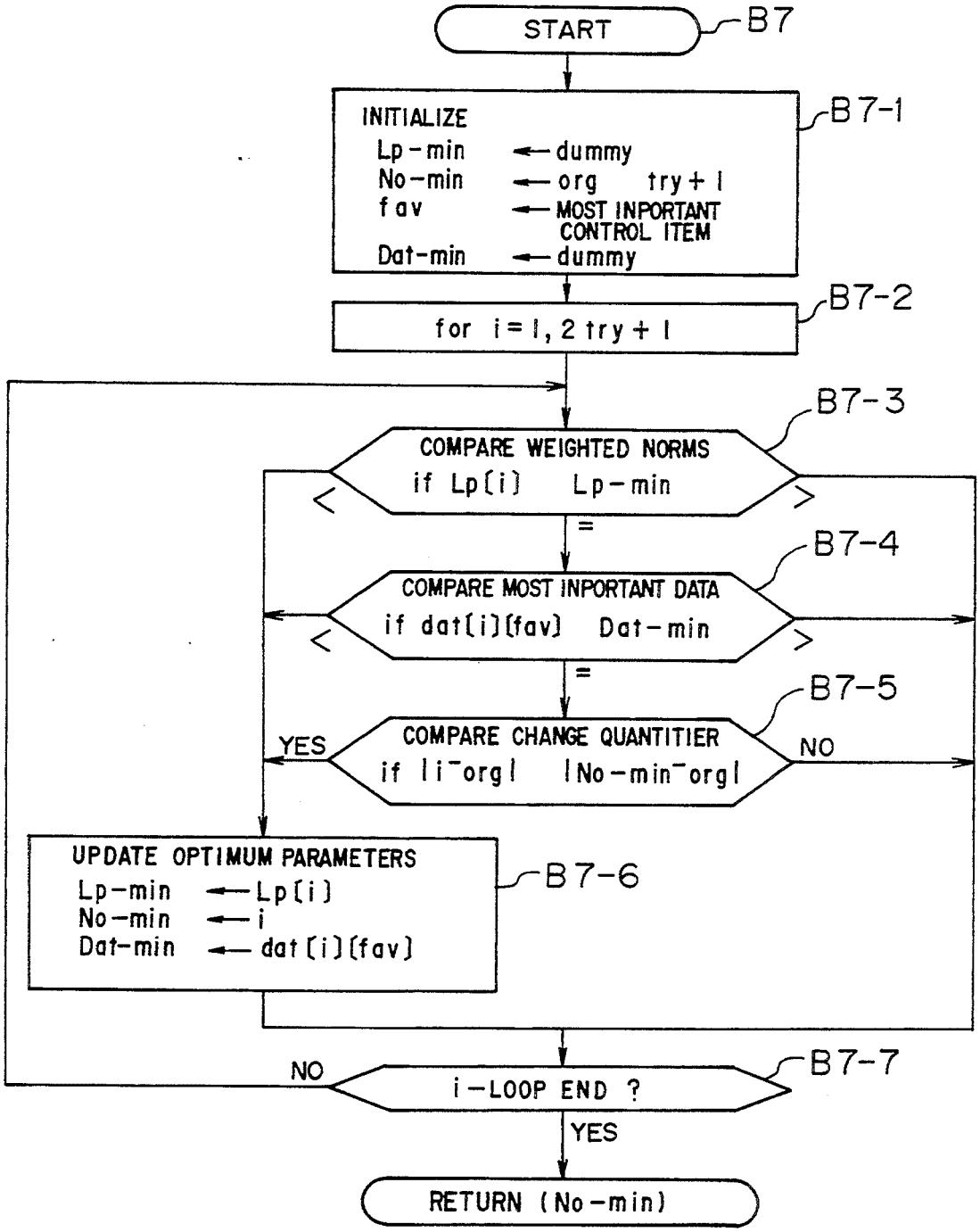
FIG. 21 is a flow chart for a minimum norm search program used in the present invention.

FIG. 21 is a flow chart of the optimum control parameter selection subroutine B7 which is used in the present invention.

At Step B7-1, a variable to be used for the comparison of an optimum control parameter is initialized. Lp-min is a variable which shows a value of the best weighted norm Lp among other norms, and a large dummy value dummy having the same size as that of the one used in the Step B5-6 in FIG. 18 is set for initialization. When this processing is done, a trial parameter which has been inappropriate for simulation is not selected. Org is a variable for showing the current parameter, and is expressed as try +1 by using the number try of parameters around. No_min is a variable showing an optimum control parameter, and the current parameter org is set as an initial value. fav shows the most important control item. Dat_min is a variable for storing a simulation result dat [No_min][fav] for the most important control item fav by the optimum control parameter tryprm [No_min] as a result of a processing.

Steps B7-2 to B7-7 are a loop processing relating to the trial parameter. At Step B7-3, a weighted norm Lp [i] corresponding to the i-th trial parameter is compared with the Lp-min. If the Lp [i] is smaller than the Lp-min, the processing proceeds to an updated processing of the optimum parameter at Step B7-6. If the Lp [i] is larger than the Lp-min, updating is not carried out and the processing goes to Step B7-7. When the Lp values are equal, no decision can be made about which is better, so that the processing proceeds to Step B7-4. In the case of comparing two results which resultantly brings about the same overall result (that is, the results of an equal weight), it is possible to select a control parameter which is closest to users' requests by giving high consideration to the result of users' most important control item. For this purpose, at Step B7-4, data of the most important control items requested by users' are compared when the Lp values are equal. In this case, if the result dat [i] [fay] by the i-th trial parameter has been better, the processing proceeds to an update processing of the optimum parameter at Step B7-6. If the result of the dat [i][fav] has been worse, no update processing is carried out, and the processing proceeds to the Step B7-7. When both data values are equal again, the processing proceeds to Step B7-5. At the Step B7-5, the current parameter is compared with the trial parameter, that is, changed quantities of a variable parameter are compared. In order to bring the current parameter close to a really optimum parameter by automatic adjusting, it is possible to restrict an excessive adjustment (overshooting) by selecting a parameter having the smaller quantity of change between the candidate parameters of the same level. By using the parameter of small change quantity, it is possible to proceed with the adjustment without giving unnatural and inconsecutive impression to the elevator car users. In the present embodiment, trial is carried out based on the current parameter as a center, so that large and small quantities of change can be calculated depending on the sequence of the trial. When the change quantity of the i-ty trial parameter is smaller as a result of a comparison of the change quantities, the processing goes to an updating of optimum parameters at Step B7-6. At the Step B7-6, optimum parameters are updated. Lp_min, No_min and Dat_min are updated to Lp [i], i and dat [i][fav] respectively. When end has been decided at the Step B7-7 as a result of repeated processing of the above, a trial sequence No_min of the optimum parameter is returned to the original program and the processing goes back to the start.

As described above, according to the first embodiment of the present invention shown in FIGS. 7 to 21, the following effects (1) to (10) can be obtained by using the "sequential adjustment system" in which a three-stage processing is carried out, that is, (i) a preparation of a trial parameter, (ii) simulation and (iii) a selection of an optimum parameter respectively for a variable parameter corresponding to each control target item based on the current parameter, and then the processing proceeds to a next variable parameter.

(1) There is an effect of reducing the time required for automatic adjustment.

(2) There is an effect of restricting an increase in the time required for automatic adjustment even if the number of variable parameters has increased.

(3) By having an automatic adjustment proceeding data table for restricting proceeding of automatic adjustment of the control method and by setting a traffic flow mode, the most important control item and an adjustment item corresponding to a difference in the proceeding of automatic adjustment, there is an effect of being able to adjust a control method which is most suitable for an actual state of the traffic flow and users' requests.

(4) By setting a maximum value and a minimum value of a variable parameter, a number of trials and a trial width in the automatic adjustment proceeding data table, there is an effect that it is possible to specify a range of parameters for automatic adjustment or details of the adjustment.

(5) By rewriting the contents of the automatic adjustment proceeding data table, there is an effect that it is possible to easily change the proceeding of automatic adjustment.

(6) By using a weighted norm which is obtained by multiplying a weight coefficient according to users' requests to a norm calculated from a difference between a simulation result and a target value and by totalling the weighted results for selecting an optimum control parameter, there is an effect that it is possible to take in various requests from elevator car users for the execution of automatic adjustment.

(7) There is an effect that it is possible to carry out an adjustment to harmonize many targets.

(8) When weighted norms are equal, there is an effect that it is possible to select a control parameter which is closest to users' requests by giving high consideration to a result of users' most important control item.

(9) For trial parameters having an equal level as a result of weighted norm and the most important control item, it is possible to restrict an excessive adjustment (an overshooting) by selecting a control parameter having the smallest change quantity.

(10) There is an effect that it is possible to proceed with automatic adjustment without giving unnatural and inconsecutive impression to users due to change in the control method.

Processing of the automatic adjustment result recording unit MR will be explained next.

Figure 22:
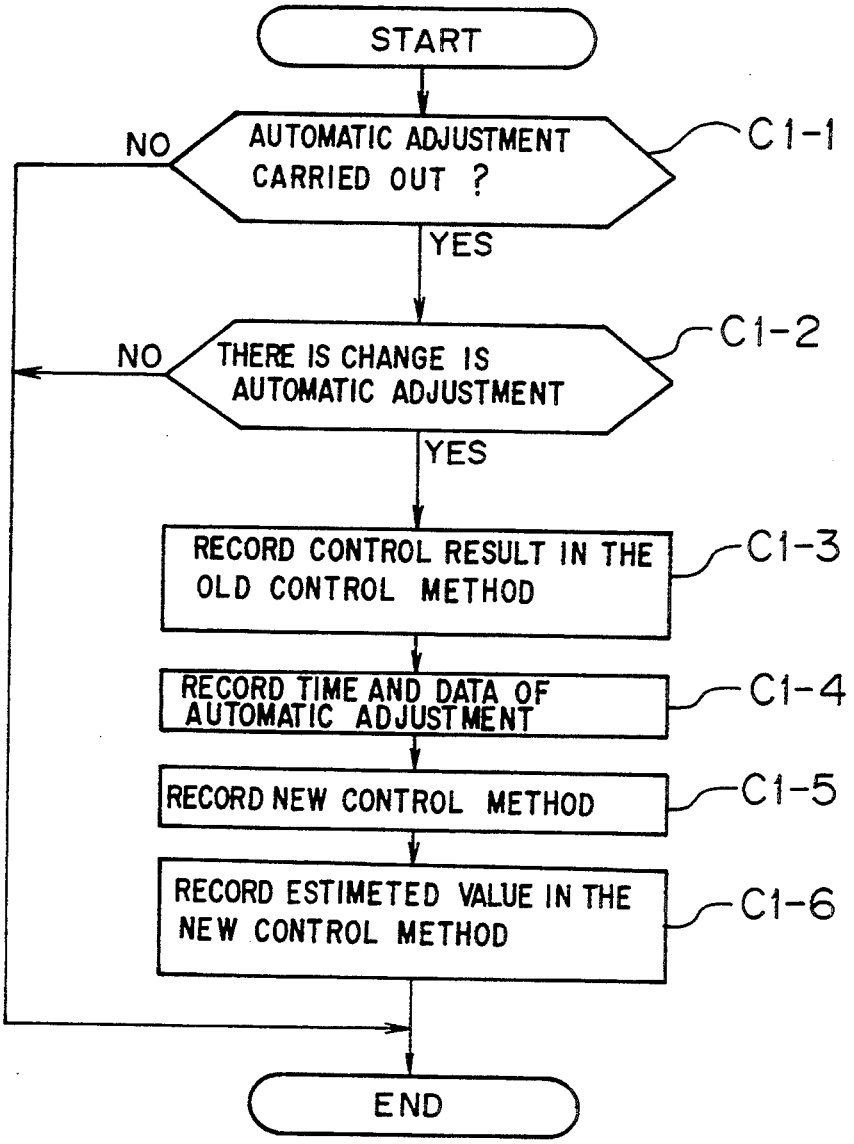
FIG. 22 is a flow chart for an automatic adjustment result record processing program used in the present invention.

FIG. 22 shows one embodiment of the automatic adjustment result record processing program according to the present invention. The automatic adjustment result record processing program can be periodically started by the timer or can be started by an end signal of the automatic adjustment program.

First, at Step C1-1, a decision is made whether automatic adjustment has been carried out or not. If the decision is No, the processing is over. If the decision is Yes, the processing proceeds to Step C1-2.

At Step C1-2, a decision is made whether there has been a change in the control method by automatic adjustment. If there has been no change in the control method, the processing is over. If there has been a change in the control method, the processing proceeds to Step C1-3.

At the Step C1-3, a result of control by the control method before the change of the control method measured by the group control execution microcomputer M1 is recorded in a tuning recording table TNRC, the contents of which will be described later.

At Step C1-4, time and date for which no adjustment has been made, that is the current time and data is recorded in the tuning recording table TNRC.

At Step C1-5, a new control method which is an output of an automatic adjustment unit is recorded in the tuning recording table TNRC. The control method to be recorded in this case covers many control parameters to be used for group control when the group control is to be carried out by an evaluation function, and control parameters and control rules to be adjusted by the automatic adjustment processing among control rules when the group control is to be carried out by an intelligence processing method.

At Step C1-6, an estimated value of the control result which has been used to prepare a new control method in the automatic adjusting unit is recorded in the tuning recording table TNRC, and the processing is over.

It is needless to mention that it is possible to implement the present invention by selecting and recording an only record which is necessary in the current situation from the records processed at the Steps C1-3 to C1-6 in the above-described automatic adjustment result record processing program.

According to the embodiment of the present invention shown in FIG. 22, there are following effects (11) to (25).

(11) By recording a result of adjustment only when there has been a change in the control method by automatic adjustment, there is an effect that it is possible to reduce the memory capacity required for the recording.

(12) By measuring a result of an actual operation and recording it by the control method before a change of the control method, there is an effect that it is possible to record how users' requests have been reflected in group control by automatic adjustment.

(13) By recording time and date of an automatic adjustment, it is possible to check by what control parameter the group control was carried out on a certain specified date of a year.

(14) As a result, there is an effect that it is possible to facilitate to find out a reason or cause for an occurrence of an inconvenience in the group control or for a complaint raised from a user, and it is also possible to reduce time required to check the reason or cause.

(15) By recording the control parameter control rule to be adjusted by automatic adjustment processing and by not recording other control method which is being fixedly used, there is an effect that it is possible to reduce a memory capacity required for the recording.

(16) There is an effect that unnecessary information is deleted and monitoring of a proceeding state of automatic adjustment becomes easy.

(17) By recording an estimated value of a result of control which has been used to prepare a new control method in the automatic adjustment unit, there is an effect that it is possible to check the reason, even at a later date, for the selection of a new control method.

(18) There is an effect that it is possible to compare an estimated value with an actual value.

(19) As a result, there is an effect that it is possible to verify the accuracy of an estimated value to be used for the automatic adjustment.

(20) There is an effect that it is possible to improve the precision of an estimate.

(21) Further, as a modification of the embodiment of the present invention, it is possible to reduce the processing of the Step C1-2 in FIG. 22. Therefore, by reducing the Step C1-2, there is an effect that a result of an automatic adjustment is recorded each time when the automatic adjustment is carried out.

(22) There is an effect that it is possible to record time and date when an automatic adjustment is carried out regardless of presence or absence of a change.

(23) There is an effect that it is possible to make clear from an output a control parameter which is frequently corrected by automatic adjustment and a control parameter which is being used stably.

(24) As a result, it is possible to decide a control parameter which should be adjusted with high priority by automatic adjustment and it is possible to improve precision and efficiency of automatic adjustment by feeding back the result of the decision to the automatic adjusting unit.

(25) There is an effect that it is possible for elevator car system designers to acquire knowledge about group control to help them contribute to improve the subsequent group control system.

Next, the contents of the tuning recording table TNRC will be explained with reference to FIG. 23.

FIG. 23 shows the contents of the tuning recording table TNRC and an example of numerical values recorded in the table.

The tuning recording table TNRC records time and date when automatic adjustment was carried out, control parameters, estimated values used for the automatic adjustment and actual values of the control result, by traffic flow characteristic mode (traffic flow mode) classified by number of passengers who have got on board or left elevator cars at each floor which indicates traffic flow quantity per unit time.

In the embodiment, a time zone for checking the traffic flow mode and preference of elevator car users in each traffic flow mode are also recorded as well as the traffic flow mode.

The table of the present embodiment shows an example of the case where numerical values are recorded each time when automatic adjustment is carried out.

The group control is carried out by individuality control for controlling reduction of waiting time, reduction of boarding time and reduction of cage crowdedness in good balance, and reduction of boarding time is given a higher priority among the control target items in this example. A multiplication factor for an estimated boarding time, a set value for a cage boarding rate and an area value for stop and evaluation have been used as an example of control parameters in this case. However, it is clear that the present invention can also be applied to other kinds of control target items and control parameters without limiting to the above-described example.

Relationship between the automatic adjustment result record processing program and the tuning recording table TNRC will be explained by taking an example of a record of a result of automatic adjustment carried out on Feb. 24, 1990.

Measured actual values for Feb. 17, 1990 which is the previous measuring time and afterward are recorded corresponding to the old control method, and then current time and date, a new control method and an estimated value are recorded. An actual measured value relating to the new control method is recorded after automatic adjustment to be carried out next time.

Last, an example of the display of a result in the automatic adjustment result display unit will be explained with reference to FIGS. 24A to 24E.

FIGS. 24A to 24D show examples of screen display in the display unit SD based on the contents of the tuning recording table TNRC. Numerical values used for the display on the display unit SD are based on those used in FIG. 23.

Table T1 shown in FIG. 24E displays the relationship between the time and date when automatic adjustment was carried out and control parameters, that is, changes in time and control method. Control parameters having vertical bars on both sides indicate that these control parameters are the result of changes by automatic adjustment.

Windows W2 to W4 at the lower side on the paper displays show relationship between automatic adjustment proceeding and control result of individual control target items. The above-described actual measured values and estimated values can be used as control results.

window W1 is a graph which shows changes in overall performance values obtained by calculating individual control results. The overall performance value is a result of adding weights of users' requests for group control to the individual control result.

The embodiment having the above-described display has the following effects (26) to (28).

(26) When an actual value is displayed as a result of a control, there is an effect that elevator car users or a building owner having the elevator system can easily check whether group control of the elevator system has actually been carried out to meet requests of the users.

(27) By displaying the overall performance and individual control results at the same time, there is an effect that relationship among the control target items and influence to the overall performance can be understood at one glance and it is possible to enable general persons like elevator car users and a building owner who are not elevator system specialists to easily indicate a new request such as, for example, a waiting time should be reduced further by placing a lower priority to boarding time.

(28) When an estimated value is displayed as a control result, it becomes possible to monitor a detailed proceeding state of automatic adjustment, and there is an effect that it facilitates an investigation of an operation state or causes by elevator system designers and maintenance personnel.

Therefore, according to the present invention there are following excellent effects;

a. Even if number of control target items has increased, it is possible to restrict an increase in time required for automatic adjustment.

b. Among a plurality of variable parameters for required targets and traffic flows, only a parameter to be adjusted is selected to ensure a secure execution of the adjustment.

c. When variable parameters to be adjusted are sequentially adjusted, there is no substantially large increase in time even if a plurality of variable parameters are to be adjusted.

We claim:

1. A group elevator control system for controlling operation of a group of elevator cars by executing a control operation of dispatching said elevator cars of said group to a plurality of floors to provide elevator service to said floors, said control operation being performed by using an evaluation function having a plurality of variable parameters, said system comprising:

means for inputting at least one of a plurality of targets each corresponding to operating performance of said group of elevator cars including a waiting time;

means for deciding to which traffic flow of a plurality of preset traffic flows a present demand for said group of elevator cars belongs;

means for storing adjustable variable parameters which have been set in advance for each of a plurality of combinations, said each combination including one of said targets and one of said traffic flows;

means for sequentially adjusting in a predetermined order values of selected adjustable variable parameters set in advance for one of said combinations corresponding to said decided traffic flow and said inputted at least one target; and group control means for dispatching elevator cars of said group to said floors utilizing said adjusted values of said selected adjustable variable parameters.

2. A group elevator control system according to claim 1, wherein said storing means stores the targets in said predetermined order, and said adjusting means sequentially adjusts said adjustable variable parameters in accordance with said predetermined order of the targets.

3. A group elevator control system for controlling operation of a group of elevator cars by executing a control operation of dispatching said elevator cars of said group to a plurality of floors to provide elevator service to said floors, said control operation being performed by using an evaluation function having a plurality of variable parameters, said system comprising:

means for inputting at least one of a plurality of targets each corresponding to operating performance of said group of elevator cars including a waiting time;

means for deciding to which traffic flow of a plurality of preset traffic flows a present demand for said group of elevator cars belongs;

means for storing an order of adjusting said variable parameters which have been set in advance for each of a plurality of combinations, said each combination including one of said targets and one of said traffic flows;

means for sequentially adjusting the values of said variable parameters according to said stored order set in advance for one of said combinations corresponding to said decided traffic flow and said inputted at least one target; and group control means for dispatching elevator cars of said group to said floors utilizing said adjusted values of said variable parameters.

4. A group elevator control system according to claim 1, further comprising:

means for recording the result of the adjusting operation performed by said adjusting means; and means for reporting the adjusting operation recorded in said result recording means in sequential order.

5. A group elevator control system according to claim 3, further comprising:

means for recording the result of the adjusting operation performed by said adjusting means; and means for reporting the adjusting operation recorded in said result recording means in sequential order.

6. A group elevator control system according to claim 1, further comprising:

means for recording the result of the adjusting operation performed by said adjusting means; and means for reporting the adjusting operation recorded in said result recording means in accordance with the change of the values of target items.

7. A group control system for elevator according to claim 3, further comprising:

means for recording the result of the adjusting operation performed by said adjusting means; and means for reporting the adjusting operation recorded in said result recording means in accordance with the change of the values of target items.

8. A group elevator control system for controlling operation of a group of elevator cars by executing a control operation of dispatching said elevator cars of said group to a plurality of floors to provide elevator service to said floors, said control operation being performed by using an evaluation function having a plurality of variable parameters, said system comprising:

means for inputting at least one of the most important control items for deciding a target having priority out of a plurality of targets each corresponding to operating performance of said group of elevator cars including a waiting time;

means for deciding to which traffic flow of a plurality of preset traffic flows a present demand for said group of elevator cars belongs;

memory means for storing variable parameters to be adjusted and adjusting order corresponding to a combination of the most important control items and the decided traffic flow;

means for varying values of the variable parameters in accordance with the adjusting order of the variable parameters read out from said memory means to calculate operating performance of said group and for sequentially adjusting the values of the variable parameters suitable for the most important control items in order; and means for controlling operation of a group of elevator cars by dispatching said elevator cars to said floors based on the adjusted values of the variable parameters.

* * * * *